US011459698B1

(12) United States Patent
Basheer

(10) Patent No.: US 11,459,698 B1
(45) Date of Patent: Oct. 4, 2022

(54) ANTIMICROBIAL COATED TEXTILES AND METHOD OF PREPARATION THEREOF

(71) Applicant: KING FAHD UNIVERSITY OF PETROLEUM AND MINERALS, Dhahran (SA)

(72) Inventor: Chanbasha Basheer, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 17/722,443

(22) Filed: Apr. 18, 2022

(51) Int. Cl.

| | |
|---|---|
| ***D06M 11/79*** | (2006.01) |
| ***D06M 11/46*** | (2006.01) |
| ***D06M 101/06*** | (2006.01) |
| ***D06M 101/32*** | (2006.01) |

(52) U.S. Cl.
CPC ..... *D06M 11/79* (2013.01); *D06M 11/46* (2013.01); *D06M 2101/06* (2013.01); *D06M 2101/32* (2013.01)

(58) Field of Classification Search
None
See application file for complete search history.

(56) References Cited

U.S. PATENT DOCUMENTS

| | | | | |
|---|---|---|---|---|
| 5,503,931 | A | 4/1996 | Goodman, Sr. | |
| 2008/0171068 | A1 * | 7/2008 | Wyner | A01N 25/10 424/404 |
| 2009/0162560 | A1 * | 6/2009 | DeLuca | C09D 7/67 524/837 |

FOREIGN PATENT DOCUMENTS

| | | | | |
|---|---|---|---|---|
| CN | 108754763 | A | 11/2008 | |
| CN | 102477691 | A | 5/2012 | |
| CN | 102511503 | A * | 6/2012 | |
| EP | 1825752 | A2 * | 8/2007 | A01N 25/08 |
| JP | 2009-23877 | A | 2/2009 | |

OTHER PUBLICATIONS

Chitra Manoharan, et al., "Synthesis, Characterization and Applications of Zno/$Tio_2$/$Sio_2$ Nanocomposite", Oriental Journal of Chemistry, vol. 34, No. 3, 2018, pp. 1333-1340.

(Continued)

*Primary Examiner* — Pegah Parvini
*Assistant Examiner* — Ross J Christie
(74) *Attorney, Agent, or Firm* — Oblon, McClelland, Maier & Neustadt, L.L.P.

(57) ABSTRACT

An antimicrobial coated textile is provided. The antimicrobial coated textile includes a textile substrate including a plurality of textile fibers and a coating. The coating includes 77.5 to 97.45 wt. % silica, 0.05 to 2.5 wt. % titanium dioxide, and 2.5 to 20 wt. % an oxide of a second metal, each based on a total weight of the coating. The second metal is selected from a group including zinc (Zn), selenium (Se), iron (Fe), copper (Cu), and zirconium (Zr), and the coating is disposed on a surface of the textile fibers. A method of preparing the antimicrobial coated textile is also provided.

13 Claims, 18 Drawing Sheets

Electron Image 1

(56) References Cited

OTHER PUBLICATIONS

S. Rukleng, et al., "Ag-doped Ti—RH—MCM-41 synthesis using rice husk silica and its antibacterial efficiency", 5$^{th}$ International Conference on Environment and Renewable Energy, IOP Publishing, IOP Conference Series: Earch and Environmental Science, vol. 307, Issue 1, 2019, pp. 1-7.

Ahmed SALAMA, et al., "Crosslinked alginate/silica/zinc oxide nanocomposite: A sustainable material with antibacterial properties", Composites Communications, vol. 7, Mar. 2018, pp. 7-11.

Monireh Zikari, et al., "Green synthesis of CuO/RHA-MCM-41 nanocomposite by solid state reaction: Characterization and antibacterial activity", Indian Journal of Chemistry, vol. 55A, Nov. 2016, pp. 1347-1351.

Palaniyandi Thennarasu, et al., "Functionalization of cotton fabric with titania silica aerogel using rice husk as precursor for enhanced UV shielding", Materials Today:Proceedings, vol. 42, 2021, pp. 795-803.

* cited by examiner

ANTIMICROBIAL COATED TEXTILES AND METHOD OF PREPARATION THEREOF

BACKGROUND

Technical Field

The present disclosure is directed to textile, particularly an antimicrobial textile, and a method of preparing the antimicrobial textile.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Antimicrobial coated textiles have attracted interest in recent years due to their potential for reducing transmission of infection in medical and health care environments. These textiles possess the ability to inhibit or eliminate microbial growth. Conventionally, antimicrobial coated textiles are coated with nanoparticles, such as silver nanoparticles, to regulate the growth of specific infectious pathogens. However, these textiles are not very resistant to washes—as a result, the concentration of silver ions, responsible for imparting the bacterial growth, gets depleted after a single wash and the textile loses its antimicrobial property after a few washes. Further, coating the textile with the silver ions involves a very cost-intensive process. Also, a cumbersome process is required to clean such antimicrobial coated textiles. Hence, there is a need for an efficient, long-lasting and an inexpensive antimicrobial coated textile which may substantially reduce or eliminate the above limitations.

SUMMARY

In an exemplary embodiment, an antimicrobial coated textile is described. The antimicrobial coated textile includes a textile substrate made up of a plurality of textile fibers, and a coating disposed on a surface of the textile fibers. The coating includes 77.5 to 97.45 wt. % silica, 0.05 to 2.5 wt. % titanium dioxide, and 2.5 to 20 wt. % an oxide of a second metal, each based on a total weight of the coating. The second metal is selected from a group consisting of Zn, Se, Fe, Cu, and Zr.

In some embodiments, the titanium dioxide is present as particles having a mean particle size of 10 to 300 nanometers (nm).

In some embodiments, the oxide of a second metal is present as particles having a mean particle size of 10 to 300 nm.

In some embodiments, the coating has a thickness of 5 to 500 micrometer (μm).

In some embodiments, the coating comprises agglomerates having a mean agglomerate size of 0.5 to 50 μm.

In some embodiments, the agglomerates collectively comprise 25 to 75 wt. % of the silica present in the coating and 25 to 75 wt. % of the oxide of the second metal present in the coating.

In some embodiments, the coating has an optical bandgap of 2 to 3.5 electron volts (eV).

In some embodiments, the textile fibers are at least one selected from a group consisting of silk, hair, linen, hemp, jute, ramie, manila, sisal, kapok, coir, cotton, a nylon, a rayon, an acrylic, a terylene, an elastane, a polyolefin, and a polyester.

In some embodiments, the textile fibers are at least one selected from a group consisting of cotton and a polyester.

In some embodiments, the antimicrobial coated textile has a water contact angle of 7.5 to 90°.

In some embodiments, the antimicrobial coated textile has a water contact angle which is 5 to 75% of a water contact angle of an uncoated textile formed of the same textile fibers.

In some embodiments, the coating comprises 86.5 to 92.25 wt. % silica, 0.25 to 1.0 wt. % titanium dioxide, and 7.5 to 12.5 wt. % of the oxide of a second metal, each based on a total weight of the coating.

In some embodiments, the coating is substantially free of binders and/or adhesives.

The present disclosure also relates to a bandage, a cast, a gown, a lab coat, a mask, a shoe covering, a face covering, a curtain, a bedcovering, a carpeting, or a head covering comprising the antimicrobial coated textile.

The present disclosure also relates to a method of forming the antimicrobial coated textile, the method comprising adding a silica powder to an aqueous base solution to form a first mixture, aging the first mixture for 4 to 24 hours to produce a silica precursor solution, adding titanium dioxide and the oxide of the second metal to an aqueous acid to form a metal precursor solution, mixing the silica precursor solution and the metal precursor solution to form a coating deposition mixture having a pH of 3 to 7, and exposing the textile substrate to the coating deposition mixture at a temperature of 125 to 175 degree Celsius (° C.) to form the antimicrobial coated textile.

In some embodiments, the aqueous acid is nitric acid and the aqueous base solution comprises an alkali metal hydroxide.

In some embodiments, the aqueous acid has a concentration of 1 to 5 Molar (M) and the aqueous base solution has a concentration of 2.5 to 10 M.

In some embodiments, the method further comprises calcining rice husk at 600 to 800° C. for 1 to 6 hours to form a rice husk ash, treating the rice husk ash with an acid solution for 6 to 48 hours to form a crude silica product, and washing the crude silica product with water to form the silica powder.

In some embodiments, the exposing is performed for 15 to 120 minutes.

In some embodiments, the exposing is performed under hydrothermal conditions.

The foregoing general description of the illustrative present disclosure and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
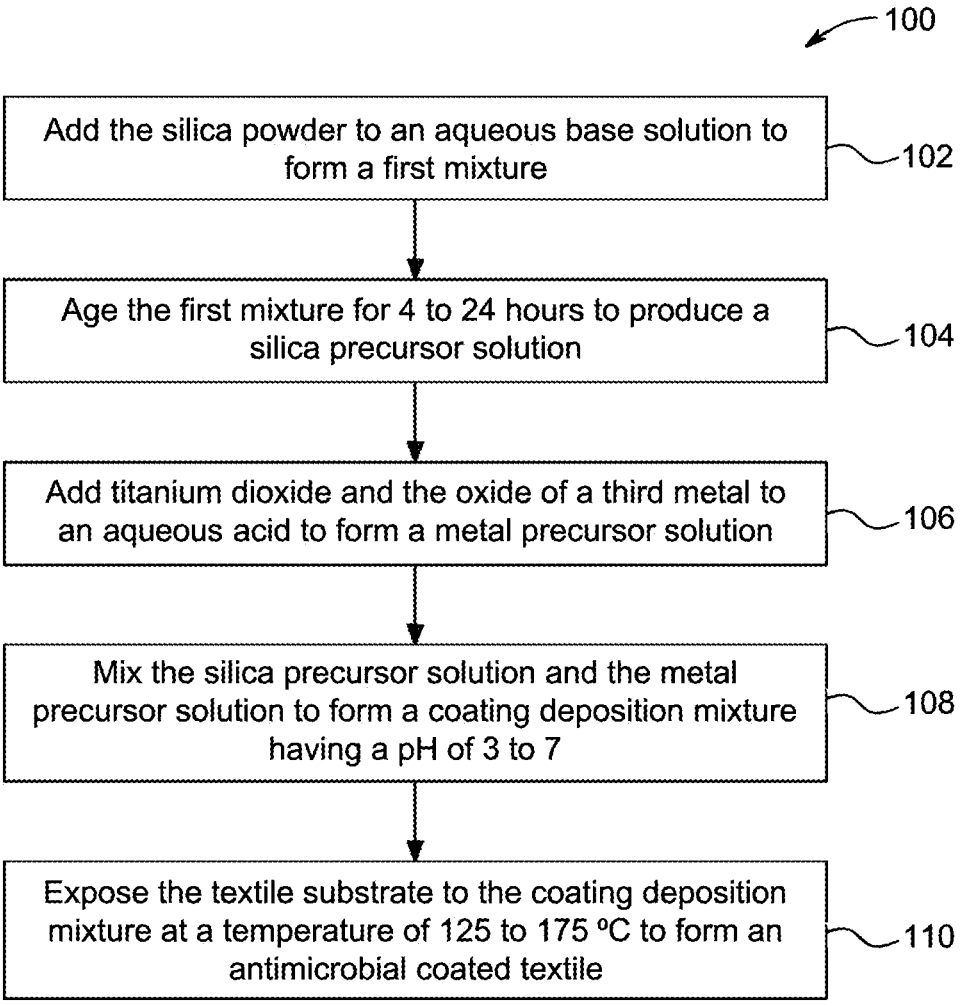
FIG. 1 is a schematic flow diagram of a method of forming a silica powder, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values there between.

The term, "uncoated textile" may interchangeably be referred to as the 'untreated textile/fabric' or 'untreated sample' or 'uncoated sample' or 'uncoated sample'.

Embodiments of the present disclosure are directed to an antimicrobial coated textile, otherwise referred to as the 'textile' or 'fabric' or 'treated textile/fabric' or 'treated sample' or 'coated sample'. A plurality of the antimicrobial coated textile may refer to as the 'textiles' or 'fabrics' or 'treated textiles/fabrics' or 'treated samples' or 'coated samples'. The textile may be, form, or be a component of any suitable good or manufacture which comprises a textile. Examples of such goods or manufactures include, but are not limited to a bandage, a cast, a gown, a lab coat, a mask, a shoe covering, a face covering, a curtain, a bedcovering, a carpeting, a head covering such as a hair band or religious, table covers, gloves and the like. Embodiments of the present disclosure are directed towards zinc/titanium oxide-containing and/or selenium/titanium oxide-containing coatings on various textile materials to form the antimicrobial coating textile. The antimicrobial textile was evaluated for its performance of its anti-bacterial activity. Experimental results with the antimicrobial textile demonstrated a significant decrease in cell viability of bacterial cells, after the bacterial cells were treated with the textile, even after the antimicrobial textile had been subject to multiple washes. In addition, the textile exhibits long-lasting antipathogenic properties, easy cleanability by photocatalytic activity, non-toxic properties, wash resistance, and low cost, thereby circumventing the drawbacks such as high manufacturing cost, and low fastness to washing that are evident in conventional antimicrobial textiles.

The antimicrobial coated textile includes a textile substrate having a plurality of textile fibers. In general, the textile may be any suitable textile known to one of ordinary skill in the art. The textile may be a natural textile. That is, the textile is formed from fibers which are derived from natural sources, such as animals or plants. Such fibers may be treated, processed, or otherwise altered prior to use or as part of forming the textile. The textile may be an artificial textile. That is, the textile is formed from fibers which are synthetic or not derived from natural sources, such as man-made polymer fibers. Examples of such suitable textiles or fibers include, but are not limited to cotton, canavas, wool, silk, linen, jute, modal, alpaca, olefin fiber, camel hair, hemp, horsehair, ixtle, flax, bamboo, alginate, rayon, polymers, and mixtures thereof. Examples of applicable polymers may include polyolefin, polyacetal, polyamide, polyester, cellulose ether and ester, polyalkylene sulfide, polyarylene oxide, polysulfone, modified polysulfone polymers, nylon, polystyrene, polyacrylonitrile, polycarbonate, polyvinyl alcohol, polyvinylpyrrolidone, poly(lactic acid), poly(lactic-co-glycolic acid), polybutylene terephthalate, polyurethane, and mixtures thereof. Examples of textiles made from polymers include, but are not limited to aramid (e.g. Twaron™, Kevlar™, and Nomex™), acrylic, nylon, spandex, ingeo, lurex, and carbon fiber. In some embodiments, the textile fibers are one or more selected from a group including silk, hair, linen, hemp, jute, ramie, manila, sisal, kapok, coir, cotton, nylon, rayon, acrylic, terylene, elastane, polyolefin, and polyester. In an embodiment, the textile fibers are cotton, polyester, or a combination thereof.

In general, the textile may be a woven textile or a non-woven textile. A woven textile may be formed from the fibers using any suitable weave, such as plain weave, twill weave, satin weave, or combinations thereof. The woven textile may be formed from threads, yarns, or other material formed from interlocked fibers which are woven to form the woven textile. It should be understood here that for the purposes of the present disclosure "woven textile" includes textile which is formed by knitting. While in a woven textile, there are separate warp and weft threads, knitting has only a single such type of thread which is looped, tied, crossed, bent, entangled, or otherwise interlocked with other threads. For the purposes of the present disclosure, the term "woven textile" refers to knit textiles, woven textiles, and other textiles in which the fibers, threads, or yarns are interlocked or otherwise connected in such an ordered fashion. This is in contrast to a non-woven textile in which the fibers, threads, or yarns are interlocked in a non-ordered fashion. A non-woven textile comprises fibers, threads, or yarns which may be interlocked, entangled, or bonded mechanically, thermally, or chemically. The non-woven textile may comprise an adhesive or a binder. The non-woven textile may be formed using any suitable technique known to one of ordinary skill in the art. For example the non-woven textile may be a staple non-woven, melt-blown, spunlaid, flashspun, needle-punched, felted, or formed by any other suitable technique.

The antimicrobial coated textile includes a coating disposed on a surface of the textile fibers. The coating comprises 77.5 to 97.45 wt. %, 78 to 97 wt. %, preferably 79 to 96 wt. %, preferably 80 to 95.5 wt. %, preferably 81 to 95 wt. %, preferably 82 to 94.5 wt. %, preferably 83 to 94 wt. %, preferably 84 to 93.5 wt. %, preferably 85 to 93 wt. %, preferably 86 to 92.5 wt. %, preferably 87 to 92 wt. %, preferably 87.5 to 91.5 wt. %, preferably 88 to 91 wt. %, preferably 88.5 to 90.5 wt. %, preferably 89 to 90 wt. %, preferably 89.5 wt. % silica, 0.05 to 2.5 wt. %, preferably 0.1 to 2.25 wt. %, preferably 0.125 to 2.0 wt. %, preferably 0.15 to 1.75 wt. %, preferably 0.175 to 1.5 wt. %, preferably 0.2 to 1.25 wt. %, preferably 0.225 to 1.0 wt. %, preferably 0.25 to 0.75 wt. %, preferably 0.275 to 0.725 wt. %, preferably 0.3 to 0.7 wt. %, preferably 0.325 to 0.675 wt. %, preferably 0.35 to 0.65 wt. %, preferably 0.375 to 0.625 wt. %, preferably 0.4 to 0.6 wt. %, preferably 0.425 to 0.575 wt. %, preferably 0.45 to 0.55 wt. %, preferably 0.475 to 0.525 wt. %, preferably 0.49 to 0.51 wt. %, preferably 0.5 wt. % titanium dioxide, and 2.5 to 20 wt. %, preferably 3.0 to 19 wt. %, preferably 3.5 to 18 wt. %, preferably 4.0 to 17 wt. %, preferably 4.5 to 16 wt. %, preferably 5.0 to 15 wt. %, preferably 5.5 to 14.5 wt. %, preferably 6.0 to 14 wt. %, preferably 6.5 to 13.5 wt. %, preferably 7.0 to 13 wt. %, preferably 7.5 to 12.5 wt. %, preferably 8 to 12 wt. %, preferably 8.5 to 11.5 wt. %, preferably 9.0 to 11.0 wt. %, preferably 9.5 to 10.5 wt. %, preferably 10 wt. % an oxide of a second metal, each based on a total weight of the coating.

In some embodiments, the silica is present as a film. The film may be continuous or discontinuous (e.g. patchy). The film may be disposed on a single fiber or may be disposed on more than one fiber. For example, the film may span a distance between two or more adjacent fibers. In some embodiments, the silica is present as particles. In general, the silica particles can be any shape known to one of ordinary skill in the art. Examples of suitable shapes the silica particles may take include spheres, spheroids, lentoids, ovoids, solid polyhedra such as tetrahedra, cubes, octahedra, icosahedra, dodecahedra, hollow polyhedral (also known as nanocages), stellated polyhedral (both regular and irregular, also known as nanostars), triangular prisms (also known as nanotriangles), hollow spherical shells (also known as nanoshells), tubes (also known as nanotubes), nanosheets, nanoplatelets, nanodisks, and mixtures thereof.

In some embodiments, the silica particles have uniform shape. Alternatively, the shape may be non-uniform. As used herein, the term "uniform shape" refers to an average consistent shape that differs by no more than 10%, by no more than 5%, by no more than 4%, by no more than 3%, by no more than 2%, by no more than 1% of the distribution of silica particles having a different shape. As used herein, the term "non-uniform shape" refers to an average consistent shape that differs by more than 10% of the distribution of silica particles having a different shape. In one embodiment, the shape is uniform and at least 90% of the silica particles are spherical or substantially circular, and less than 10% are polygonal.

In some embodiments, the silica particles have a mean particle size of 50 to 500 nm, preferably 75 to 475 nm, preferably 100 to 450 nm, preferably 125 to 425 nm, preferably 150 to 400 nm, preferably 175 to 375 nm, preferably about 200 to 350 nm. In embodiments where the silica particles are spherical, the particle size may refer to a particle diameter. In embodiments where the silica particles are polyhedral, the particle size may refer to the diameter of a circumsphere. In some embodiments, the particle size refers to a mean distance from a particle surface to particle centroid or center of mass. In alternative embodiments, the particle size refers to a maximum distance from a particle surface to a particle centroid or center of mass. In some embodiments where the silica particles have an anisotropic shape, the particle size may refer to a length of the particle, a width of the particle, an average of the length and width of the particle. In some embodiments in which the silica particles have non-spherical shapes, the particle size refers to the diameter of a sphere having an equivalent volume as the particle. In some embodiments in which the silica particles have non-spherical shapes, the particle size refers to the diameter of a sphere having an equivalent diffusion coefficient as the particle.

In some embodiments, the silica particles of the present disclosure are monodisperse, having a coefficient of variation or relative standard deviation, expressed as a percentage and defined as the ratio of the particle size standard deviation ($\sigma$) to the particle size mean ($\mu$) multiplied by 100 of less than 25%, preferably less than 10%, preferably less than 8%, preferably less than 6%, preferably less than 5%, preferably less than 4%, preferably less than 3%, preferably less than 2%. In some embodiments, the silica particles of the present disclosure are monodisperse having a particle size distribution ranging from 80% of the average particle size to 120% of the average particle size, preferably 90-110%, preferably 95-105% of the average particle size. In some embodiments, the silica particles are not monodisperse.

In general, the particle size may be determined by any suitable method known to one of ordinary skill in the art. In some embodiments, the particle size is determined by powder X-ray diffraction (PXRD). Using PXRD, the particle size may be determined using the Scherrer equation, which relates the full-width at half-maximum (FWHM) of diffraction peaks to the size of regions comprised of a single crystalline domain (known as crystallites) in the sample. In some embodiments, the crystallite size is the same as the particle size. For accurate particle size measurement by PXRD, the particles should be crystalline, comprise only a single crystal, and lack non-crystalline portions. Typically, the crystallite size underestimates particle size compared to other measures due to factors such as amorphous regions of particles, the inclusion of non-crystalline material on the surface of particles such as bulky surface ligands, and particles which may be composed of multiple crystalline domains. In some embodiments, the particle size is determined by dynamic light scattering (DLS). DLS is a technique which uses the time-dependent fluctuations in light scattered by particles in suspension or solution in a solvent, typically water to measure a size distribution of the particles. Due to the details of the DLS setup, the technique measures a hydrodynamic diameter of the particles, which is the diameter of a sphere with an equivalent diffusion coefficient as the particles. The hydrodynamic diameter may include factors not accounted for by other methods such as non-crystalline material on the surface of particles such as bulky surface ligands, amorphous regions of particles, and surface ligand-solvent interactions. Further, the hydrodynamic diameter may not accurately account for non-spherical particle shapes. DLS does have an advantage of being able to account for or more accurately model solution or suspension behavior of the particles compared to other techniques. In some embodiments, the particle size is determined by electron microscopy techniques such as scanning electron microscopy (SEM) or transmission electron microscopy (TEM).

In some embodiments, the silica particles comprise primarily $SiO_2$ as an inorganic fraction. The silica particles may have one or more inorganic impurities (e.g., calcium oxide, magnesium oxide, potassium oxide, iron oxide, sodium) present. Such inorganic impurities may be present on an exterior surface of the silica particles, an interior surface of the silica particles, or incorporated into the silica particles, for example embedded in the silica matrix. In some embodiments, the silica particles have an inorganic impurity content of less than 4 wt. %, preferably less than 2 wt. %, preferably less than 1.5 wt. %, preferably less than 1 wt. %, preferably less than 0.5 wt. %, preferably less than 0.1 wt. %, preferably less than 0.05 wt. %. Preferably, the silica particles are devoid of inorganic impurities listed above. Note that the inorganic impurities listed above do not refer to the titanium dioxide particles and/or the particles of the oxide of the second metal described below. The silica particles may have a carbon content of less than 20 wt. %, preferably less than 18 wt. %, preferably less than 16 wt. %, preferably less than 14 wt %, preferably less than 12 wt %, preferably less than 10 wt %, preferably less than 8 wt %, preferably less than 6 wt %, preferably less than 4 wt %, preferably less than 2 wt %, based on a total weight of the silica particles.

In some embodiments, the titanium dioxide is present as particles. In general, the titanium dioxide particles can be any shape known to one of ordinary skill in the art as described above. In some embodiments, the titanium dioxide is present as particles having a mean particle size of 10 to 300 nanometers (nm), preferably 25 to 275 nm, preferably 50 to 250 nm, preferably 75 to 225 nm, preferably 100 to 200 nm.

In some embodiments, the oxide of a second metal is present as particles. In general, the oxide of the second metal particles can be any shape known to one of ordinary skill in the art as described above. In some embodiments, the oxide of the second metal is present as particles having a mean particle size of 10 to 300 nm, preferably 25 to 275 nm, preferably 50 to 250 nm, preferably 75 to 225 nm, preferably 100 to 200 nm.

The second metal is selected from a group including zinc (Zn), selenium (Se), iron (Fe), copper (Cu), and zirconium (Zr). In another embodiment, the second metal may also be selected from another group including palladium (Pd) and boron (B). Although the examples described herein, refer to use of Zn and Se as the oxide of the second metal in the coating, it should be noted that aspects of the present disclosure can be applied with use of other oxides of the second metals such as, iron, copper, zirconium, and palladium as well.

In some embodiments, the coating comprises agglomerates. Such agglomerates may comprise any combination of silica particles, titanium dioxide particles, or particles of an oxide of a second metal. Each of these particles may have sizes as described above. These particles may form the primary particles of the agglomerate. In some embodiments, the agglomerates have a mean agglomerate size of 0.5 to 50 μm, preferably 1 to 47.5 μm, preferably 1.5 to 45 μm, preferably 2 to 42.5 μm, preferably 2.5 to 40 μm, preferably 3 to 37.5 μm, preferably 3.5 to 35 μm, preferably 4 to 32.5 μm, preferably 4.5 to 30 μm, preferably 5 to 27.5 μm. In some embodiments, the agglomerates may be uniformly distributed across the textile fibers. In some embodiments, the agglomerates may be non-uniformly distributed across the textile fibers. In some embodiments, a single agglomerate may be disposed on a single fiber or may be disposed on more than one fiber. For example, the agglomerate may span a distance between two or more adjacent fibers. In some embodiments, the agglomerates or the primary particles may be present in spaces between adjacent fibers of the textile. For example, in a woven textile, the primary particles or agglomerates may be present where warp fibers and weft fibers intersect, or may be present in a space defined by an adjacent pair of warp fibers and an adjacent pair of weft fibers. In some embodiments, the agglomerates collectively include 25 to 75 wt. %, preferably 30 to 70 wt. %, preferably 35 to 65 wt. %, preferably 40 to 60 wt. % of the silica present in the coating and 25 to 75 wt. %, preferably 30 to 70 wt. %, preferably 35 to 65 wt. %, preferably 40 to 60 wt. % of the oxide of the second metal present in the coating.

In some embodiments, the coating has a thickness of 5 to 500 micrometers (μm), preferably 5.5 to 475 μm, preferably 6 to 450 μm, preferably 6.5 to 425 μm, preferably 7 to 400 μm, preferably 7.5 to 390 μm, preferably 8 to 380 μm, preferably 8.5 to 370 μm, preferably 9 to 360 μm, preferably 9.5 to 350 μm, preferably 10 to 340 μm, preferably 10.5 to 330 μm, preferably 11 to 320 μm, preferably 12 to 310 μm, preferably 12.5 to 300 μm. In some embodiments, the thickness is a mean thickness. In some embodiments, the thickness is a minimum thickness. In some embodiments, the thickness is a maximum thickness. In some embodiments, the thickness is uniform, having a standard deviation of less than 25%, preferably less than 22.5%, preferably less than 20%, preferably less than 17.5%, preferably less than 15%, preferably less than 12.5%, preferably less than 10%, preferably less than 7.5%, preferably less than 5%. In some embodiments, the thickness is not uniform.

In some embodiments, the coating is substantially free of binders and/or adhesives.

In some embodiments, the coating has a surface roughness (Ra) of 0.1 to 50 μm, preferably 0.25 to 45 μm, preferably 0.5 to 40 μm, preferably 0.75 to 35 μm, preferably 1 to 30 μm, preferably 1.25 to 27.5 μm, preferably 1.5 to 25 μm, preferably 1.75 to 22.5 μm, preferably 2 to 20 μm, preferably 2.5 to 19 μm, preferably 2.25 to 18.5 μm, preferably 2.5 to 18 μm, preferably 2.75 to 17.5 μm, preferably 3 to 17 μm, preferably 3.25 to 16.75 μm, preferably 3.5 to 16.5 μm, preferably 3.75 to 16.25 μm, preferably 4 to 16 μm, preferably 4.25 to 15.75 μm, preferably 4.5 to 15.5 μm, preferably 4.75 to 15.25 μm, preferably 5 to 15 μm.

In some embodiments, the coating has an optical bandgap of 2 to 3.5 electron volts (eV), preferably 2.05 to 3.45 eV, preferably 2.1 to 3.4 eV, preferably 2.15 to 3.35 eV, preferably 2.2 to 3.3 eV, preferably 2.25 to 3.25 eV, preferably 2.3 to 3.2 eV.

In some embodiments, the coated textile has a water contact angle of 7.5 to 90°, preferably 8 to 88°, preferably 8.5 to 86°, preferably 9 to 84°, preferably 9.5 to 83°, preferably 10 to 82°, preferably 10.5 to 81°, preferably 11 to 80°. In some embodiments, the textile fibers are cotton and the coated textile has a water contact angle of 15 to 50°, preferably 20 to 47.5°, preferably 22.5 to 45°, preferably 25 to 42.5°, preferably 27.5 to 40°, preferably 30 to 37.5°, preferably 32.5 to 36°. In some embodiments, the textile fibers are a polyester and the coated textile has a water contact angle of 15 to 50°, preferably 20 to 47.5°, preferably 22.5 to 45°, preferably 25 to 42.5°, preferably 27.5 to 40°, preferably 30 to 37.5°, preferably 32.5 to 36°. In some embodiments, the textile comprises cotton fibers and polyester fibers and the coated textile has a water contact angle of 7.5 to 25°, preferably 8 to 22.5°, preferably 8.5 to 20°, preferably 9 to 18°, preferably 9.5 to 16°, preferably 10 to 14°, preferably 10.5 to 13°, preferably 11 to 12.5°, preferably 11.5 to 12°. Standard procedure and specifications adopted for water contact angle measurements are provided in ASTM D7334 [ASTM:D7334-08, Standard Practice for Surface Wettability of Coating, Substrates and Pigments by Advancing Contact Angle Measurement, (2013), incorporated herein by reference in its entirety].

In some embodiments, the antimicrobial coated textile has a water contact angle which is 5 to 75%, preferably 7.5 to 72.5%, preferably 10 to 70%, preferably 11 to 68%, preferably 12 to 66% of a water contact angle of an uncoated textile formed of the same textile fibers.

The present disclosure also relates to a method of forming the coated textile. Referring to FIG. 1, a schematic flow diagram of the method 100 of forming the antimicrobial coated textile is illustrated. The order in which the method 100 is described is not intended to be construed as a limitation, and any number of the described method steps may be combined in any order to implement the method 100. Additionally, individual steps may be removed or skipped from the method 100 without departing from the spirit and scope of the present disclosure.

At step 102, the method 100 includes adding a silica powder to an aqueous base solution to form a first mixture. In general, the silica powder may be any suitable silica powder known to one of ordinary skill in the art. In some embodiments, the silica powder comprises silica particles which are substantially the same as (i.e. have substantially the same shape and/or size) the silica particles present in the coating as described above. In some embodiments, the silica powder comprises silica particles which are different from the silica particles present in the coating. In some embodiments, the silica powder is a silica powder prepared by the method 200 described below. In an embodiment, the aqueous base solution includes an alkali metal hydroxide. The alkali metal hydroxide may be sodium hydroxide, potassium hydroxide, lithium hydroxide or a combination thereof. In an embodiment, the alkali metal hydroxide is sodium hydroxide. The aqueous base solution has a concentration in a range of 2.5 to 10 M, preferably 3 to 9.5 M, preferably 3.25 to 9 M, preferably 3.5 to 8.5 M, preferably 3.75 to 8.25 M, preferably 4 to 8 M, preferably 4.25 to 7.75 M, preferably 4.5 to 7.5 M, preferably 4.75 to 7.25 M, preferably 5 to 7 M, preferably 5.25 to 6.75 M, preferably 5.5 to 6.5 M, preferably 5.75 to 6.25 M, preferably 6 M.

At step 104, the method 100 includes aging the first mixture for 4 to 24, preferably 6 to 20 hours, preferably 8 to 16 hours, preferably 10 to 14 hours, preferably 11 to 13 hours, preferably 12 hours to produce a silica precursor solution.

At step 106, the method 100 includes adding titanium dioxide and the oxide of the second metal to an aqueous acid to form a metal precursor solution. In general, the aqueous acid may be any suitable acid known to one of ordinary skill in the art, such as sulfuric acid, hydrochloric acid, nitric acid, formic acid, acetic acid, chloric acid, perchloric acid, hydrobromic acid, hydroiodic acid, phosphoric acid, and the like. Examples of unsuitable acids include hydrofluoric acid, silicic acid, hexafluorosilicic acid, fluorosulfonic acid, hexafluorophosphoric acid, and the like. The presence of silicon and/or fluorine (or ions thereof) in such acids may interfere with the formation of the coating. In some embodiments, the aqueous acid is nitric acid. In an embodiment, the aqueous acid has a concentration of 1 to 5 M, preferably 1.25 to 4.75 M, preferably 1.5 to 4.5 M, preferably 1.75 to 4.25 M, preferably 2 to 4 M, preferably 2.25 to 3.75 M, preferably 2.5 to 3.5 M, preferably 2.75 to 3.25 M, preferably 2.9 to 3.1 M, preferably 3 M.

At step 108, the method 100 includes mixing the silica precursor solution and the metal precursor solution to form a coating deposition mixture having a pH in a range of 3 to 7, preferably 3.25 to 6.75, preferably 3.5 to 6.5, preferably 3.75 to 6.25, preferably 4 to 6, preferably 4.25 to 5.75, preferably 4.5 to 5.5, preferably 4.75 to 5.25, preferably 4.9 to 5.1, preferably 5.

At step 110, the method 100 includes exposing the textile substrate to the coating deposition mixture at the temperature of 125 to 175° C., preferably 130 to 170° C., preferably 135 to 165° C., preferably 140 to 160° C., preferably 145 to 155° C., preferably 150° C. to form the antimicrobial coated textile. In an embodiment, exposing of the textile substrate to the coating deposition mixture is performed for 15 to 120 minutes, preferably 20 to 110 minutes, preferably 25 to 100 minutes, preferably 30 to 90 minutes, preferably 35 to 85 minutes, preferably 40 to 80 minutes, preferably 45 to 75 minutes, preferably 50 to 70 minutes, preferably 55 to 65 minutes, preferably 60 minutes. In an embodiment, exposing of the textile substrate to the coating deposition mixture is performed under hydrothermal conditions.

Figure 2:
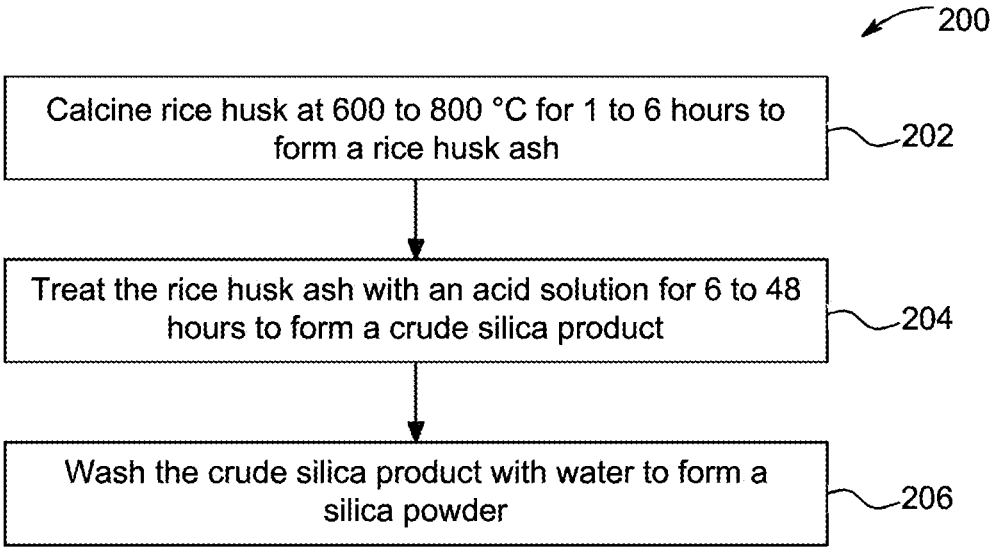
FIG. 2 is a schematic flow diagram of a method of forming an antimicrobial coated textile, according to certain embodiments.

Referring to FIG. 2, a schematic flow diagram of a method 100 of forming a silica powder is illustrated. The method 200 is described with reference to formation of the antimicrobial coated textile illustrated in FIG. 1. The order in which the method 200 is described is not intended to be construed as a limitation, and any number of the described method steps may be combined in any order to implement the method 200. Additionally, individual steps may be removed or skipped from the method 200 without departing from the spirit and scope of the present disclosure.

At step 202, the method 200 includes calcining a rice husk at 600 to 800 degrees Celsius (° C.), preferably 625 to 775° C., preferably 650 to 750° C., preferably 675 to 725° C., preferably 690 to 710° C., preferably 700° C. for 1 to 6 hours, preferably 1.25 to 5.5 hours, preferably 1.5 to 5 hours, preferably 2 to 4.5 hours, preferably 2.25 to 4 hours, preferably 2.5 to 3.5 hours, preferably 2.75 to 3.25 hours, preferably 3 hours to form a rice husk ash (RHA).

In some embodiments, the rice husk ash has a carbon content of less than 20 wt. %, preferably less than 18 wt. %, preferably less than 16 wt. %, preferably less than 14 wt %, preferably less than 12 wt %, preferably less than 10 wt %, preferably less than 8 wt %, preferably less than 6 wt %, preferably less than 4 wt %, preferably less than 2 wt %, each based on a total weight of the rice husk ash. Preferably, the rice husk ash utilized herein contains primarily $SiO_2$ as an inorganic fraction, and has an inorganic impurity (e.g., calcium oxide, magnesium oxide, potassium oxide, iron oxide, titanium oxide, sodium) content of less than 4 wt. %, preferably less than 2 wt. %, preferably less than 1.5 wt. %, preferably less than 1 wt. %, preferably less than 0.5 wt. %, preferably less than 0.1 wt. %, preferably less than 0.05 wt. %.

At step 204, the method 200 includes treating the RHA with an acid solution for 6 to 48 hours, preferably 8 to 44 hours, preferably 10 to 40 hours, preferably 12 to 36 hours, preferably 14 to 34 hours, preferably 16 to 32 hours, preferably 18 to 30 hours, preferably 20 to 28 hours, preferably 22 to 26 hours, preferably 24 hours to form a crude silica product. In some embodiments, the acid solution may comprise any suitable acid as described above. In an embodiment, the acid solution comprises nitric acid. In an embodiment, the nitric acid has a concentration of 1 Molar (M). Such treating may be advantageous for removing and/or minimizing inorganic impurities such as calcium oxide, magnesium oxide, potassium oxide, iron oxide, titanium oxide, sodium, and the like which may be present in the rice husk ash. Preferably, the crude silica product produced contains primarily $SiO_2$ as an inorganic fraction, and has an inorganic impurity (e.g., calcium oxide, magnesium oxide, potassium oxide, iron oxide, titanium oxide, sodium) content of less than 4 wt. %, preferably less than 2 wt. %, preferably less than 1.5 wt. %, preferably less than 1 wt. %, preferably less than 0.5 wt. %, preferably less than 0.1 wt. %, preferably less than 0.05 wt. %. Preferably, the crude silica product produced is devoid of inorganic impurities listed above.

At step 206, the method 200 includes washing the crude silica product with water to form the silica powder. The silica powder prepared by method 200 may be useful for preparing the antimicrobial coated textile described above. In some embodiments, the silica powder contains primarily $SiO_2$ as an inorganic fraction, and has an inorganic impurity (e.g., calcium oxide, magnesium oxide, potassium oxide, iron oxide, titanium oxide, sodium) content of less than 4 wt. %, preferably less than 2 wt. %, preferably less than 1.5 wt. %, preferably less than 1 wt. %, preferably less than 0.5 wt. %, preferably less than 0.1 wt. %, preferably less than 0.05 wt. %. Preferably, the silica powder is devoid of inorganic impurities listed above. The silica powder may have a carbon content of less than 20 wt. %, preferably less than 18 wt. %, preferably less than 16 wt. %, preferably less than 14 wt %, preferably less than 12 wt %, preferably less than 10 wt %, preferably less than 8 wt %, preferably less than 6 wt %, preferably less than 4 wt %, preferably less than 2 wt %, based on a total weight of the silica powder.

Where a numerical limit or range is stated herein, the endpoints are included. Also, all values and subranges within a numerical limit or range are specifically included as if explicitly written out.

Obviously, numerous modifications and variations of the present invention are possible in light of the above teachings. It is therefore to be understood that, within the scope of the appended claims, the invention may be practiced otherwise than as specifically described herein.

EXAMPLES

The following examples describe and demonstrate exemplary embodiments of the antimicrobial coated textile as described herein. The examples are provided solely for the purpose of illustration and are not to be construed as limitations of the present disclosure, as many variations thereof are possible without departing from the spirit and scope of the present disclosure.

Materials

A nitric acid ($HNO_3$), sodium hydroxide (NaOH), titanium dioxide ($TiO_2$), a rice husk (RH) waste, distilled water, metals such as Zn, Se, Fe, Cu, and Zr were used.

Method of Preparation

Figure 3:
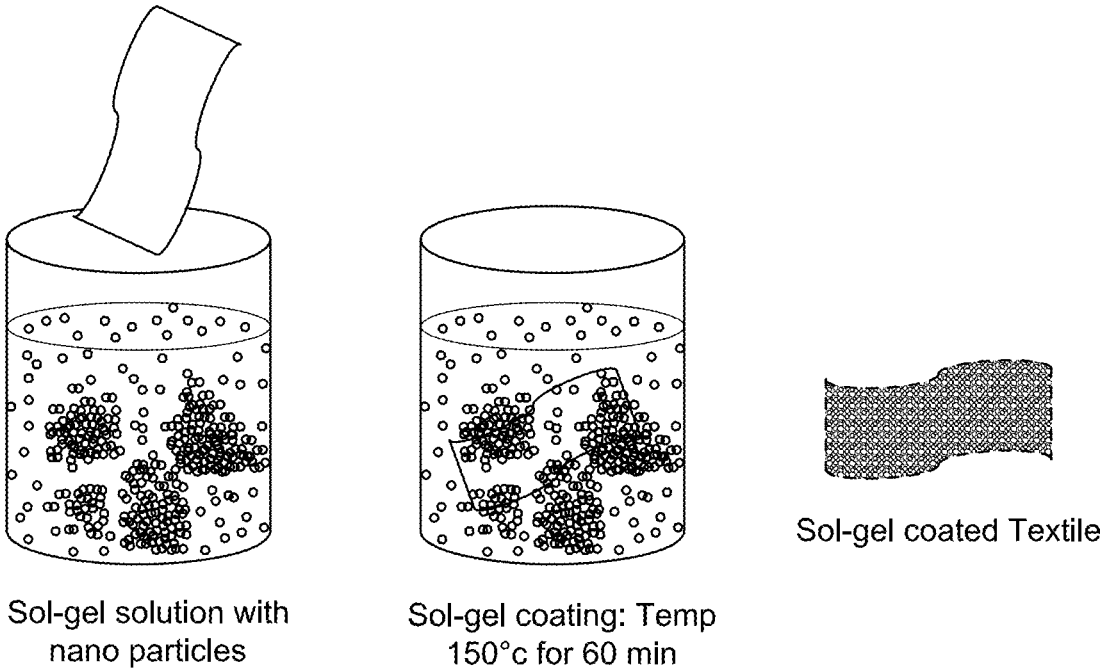
FIG. 3 is a schematic view of preparation of the antimicrobial coated textile, according to certain embodiments.

Referring to FIG. 3, a schematic view of preparation of the textile is illustrated. A sol-gel material from rice husk (RH) waste was prepared. The RH waste was cleaned with distilled water and incinerated controllably to form the silica powder at 700 degrees Celsius (° C.) for 3 hours. The silica powder was treated with 1.0 Molar (M) $HNO_3$ for 24 hours followed by filtration and washed with de-ionized water until a constant pH value to form a rice husk ash (RHA). The RHA was dried at 150° C. 10.0 gram (g) of the RHA was added in 250 milliliters (ml) of 6.0 M NaOH, stirred for 12 hours and filtered to remove an undissolved material. Filtrate was rapidly titrated with 10% of metal solutions to form sample/samples. The metal solutions such as Zn, Se, Fe, Cu, Zr with $TiO_2$, was prepared separately, each dissolved in 200 ml of 3.0 M $HNO_3$ and loaded individually. The filtrate was rapidly titrated with the metal solutions, drop by drop, until a pH 5 was obtained. Pre-cleaned textile fabrics such as non-woven textiles, cotton, polyester, and blended textiles were immersed in the sample, and further autoclaved for 1 hour at 15° C. The textiles were washed with the water and then dried at room temperature.

Characterization

Figure 4A:
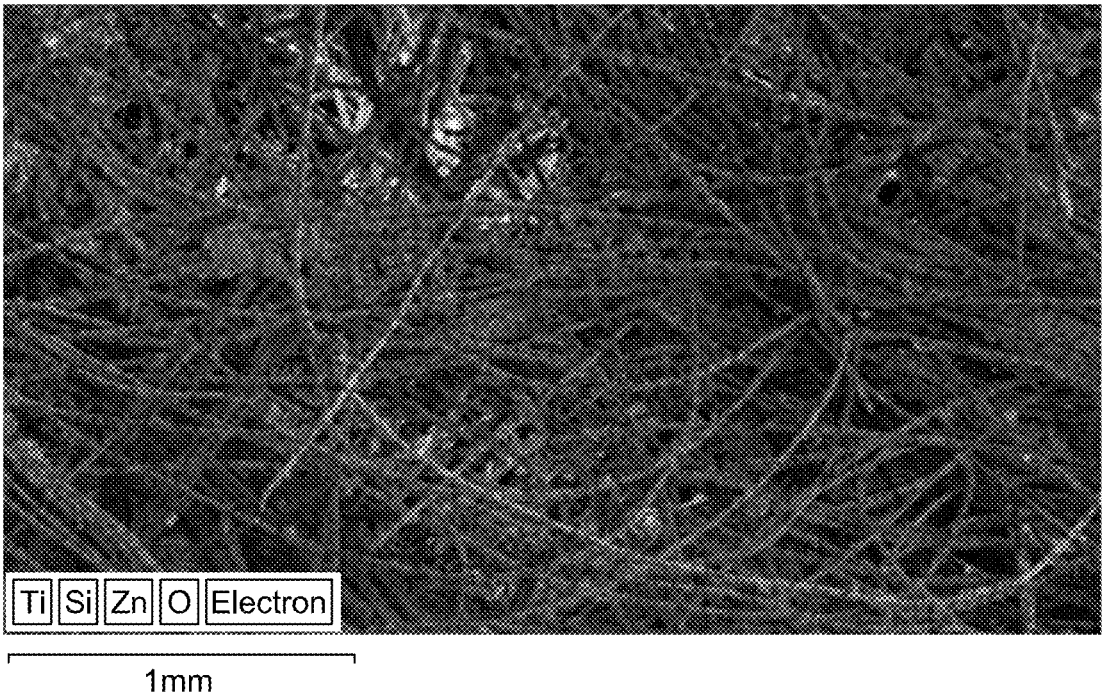
FIGS. 4A-4B illustrate scanning electron microscopy (SEM) images of treated cotton textile, and untreated cotton textiles, according to certain embodiments.
Figure 4B:
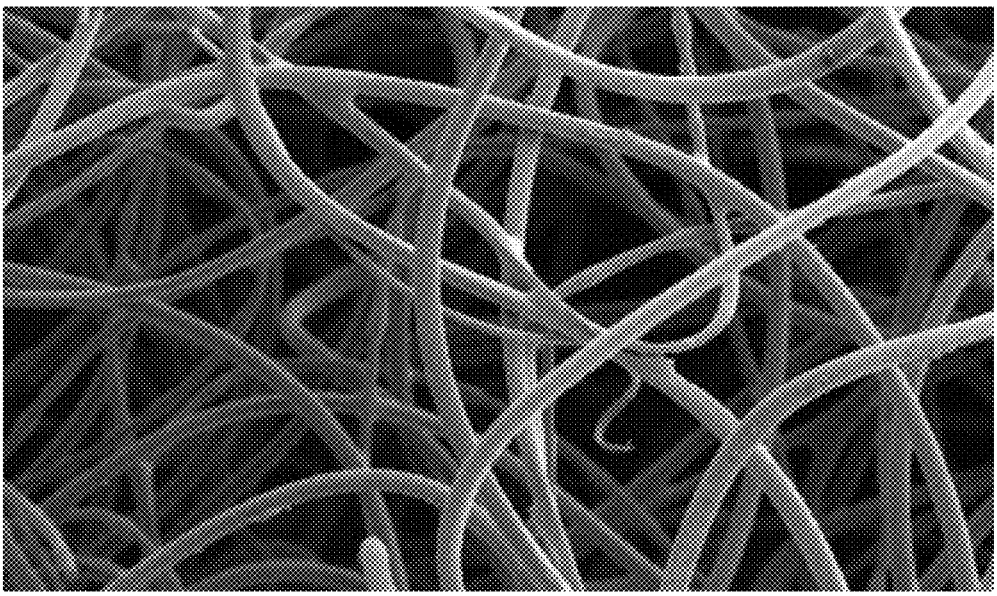
Figure 5:
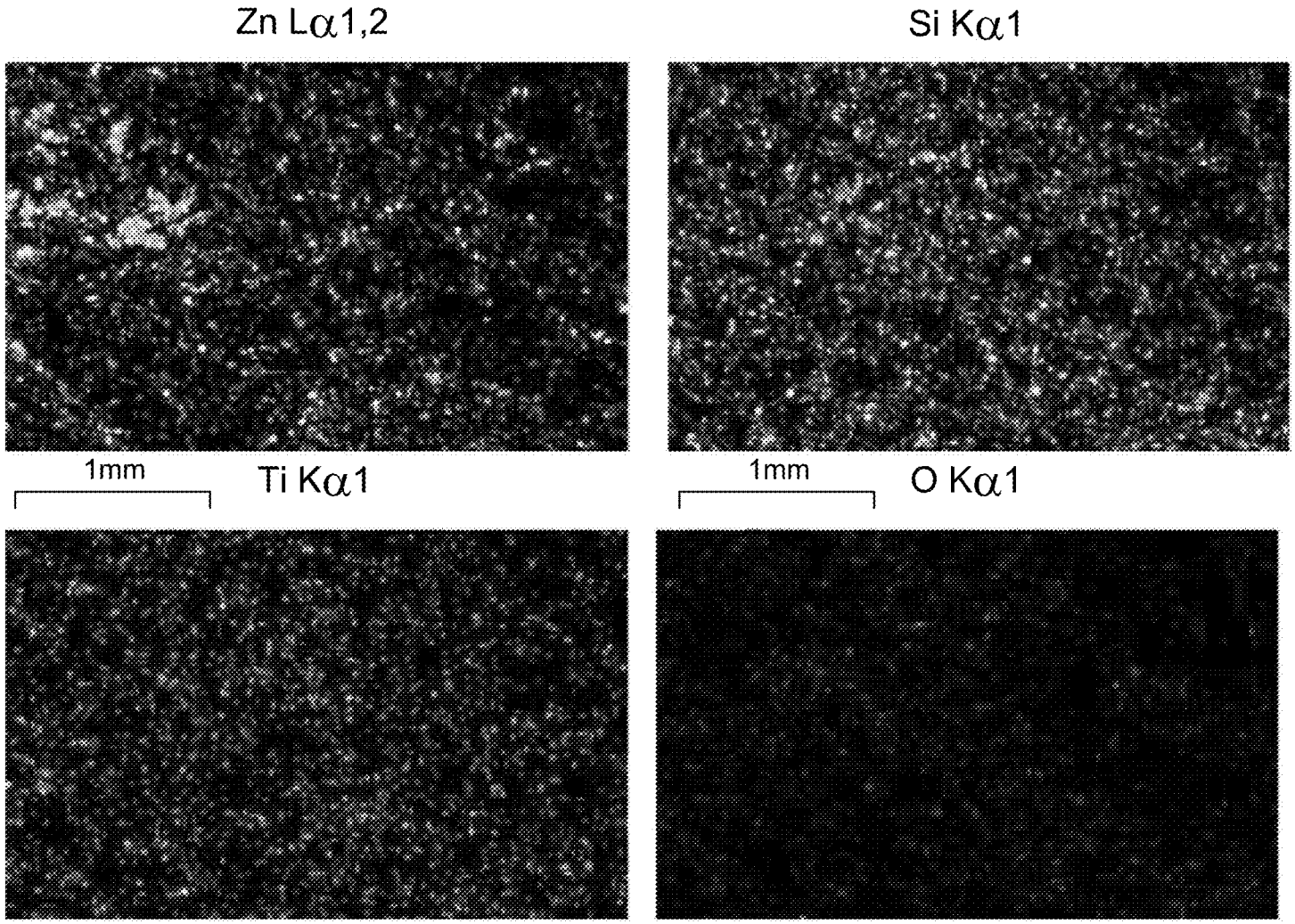
FIG. 5 illustrates an Energy-dispersive X-ray spectroscopy (EDX) image of the treated cotton textile, according to certain embodiments.

Scanning electron microscopy (SEM) images of treated and untreated cotton fabrics was performed (Lyra3 TESCAN) to investigate the textiles surface, and the results of the present study are shown in FIGS. 4A-4B, respectively. Comparison of the FIGS. 4A and 4B reveal that the treated fabric shows a uniform coating of nanoparticles on the surface of the cotton fabric, as can be observed in the FIG. 4A. Furthermore, the elemental composition of the treated cotton fabric was confirmed with Energy-dispersive X-ray spectroscopy (EDX). The EDX image of the treated cotton fabric is shown in FIG. 5, and the results reveal the presence of Zn oxide, Si, Ti and O present on the cotton fabric.

Figure 6:
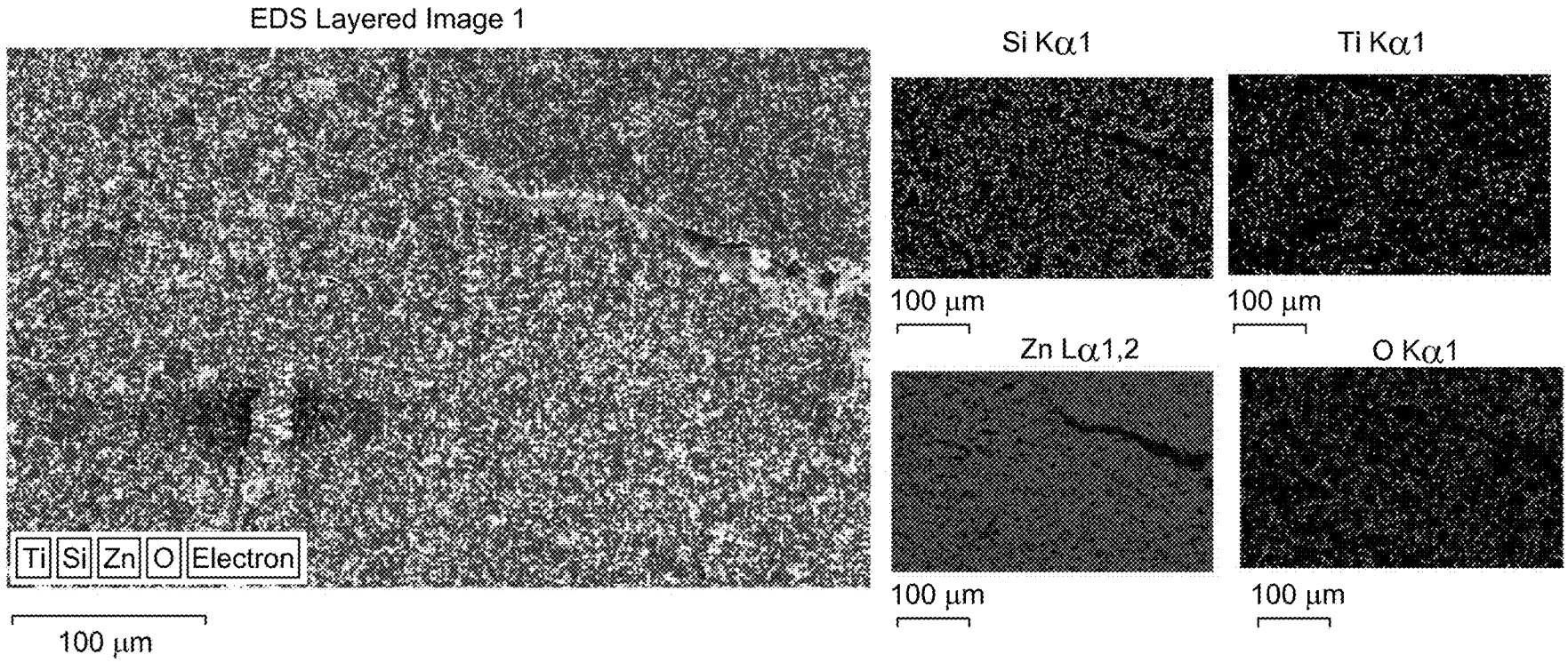
FIG. 6 illustrates an EDX image of a polytetrafluoroethylene (PTFE) textile, according to certain embodiments.

Similarly, EDX images of the polytetrafluoroethylene (PTFE) fabric is shown in FIG. 6, respectively. From the FIG. 6, it can be observed that the EDX confirms presence of the coating on the surface of the PTFE fabric. FIG. 6 confirms the presence of elements such as Zn, Si, Ti, O present on the PTFE fabric.

Figure 7A:
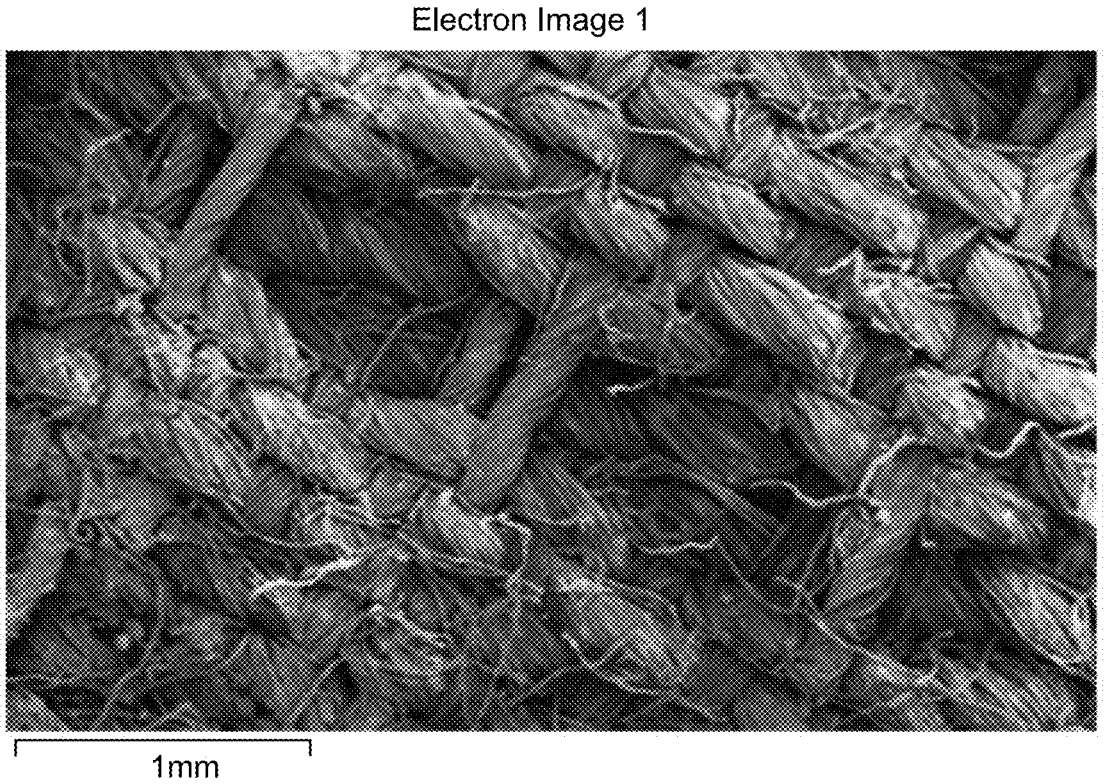
FIGS. 7A-7B illustrate the SEM and the EDX images of the antimicrobial coated textile including zinc (Zn) nanoparticles, according to certain embodiments.
Figure 7B:
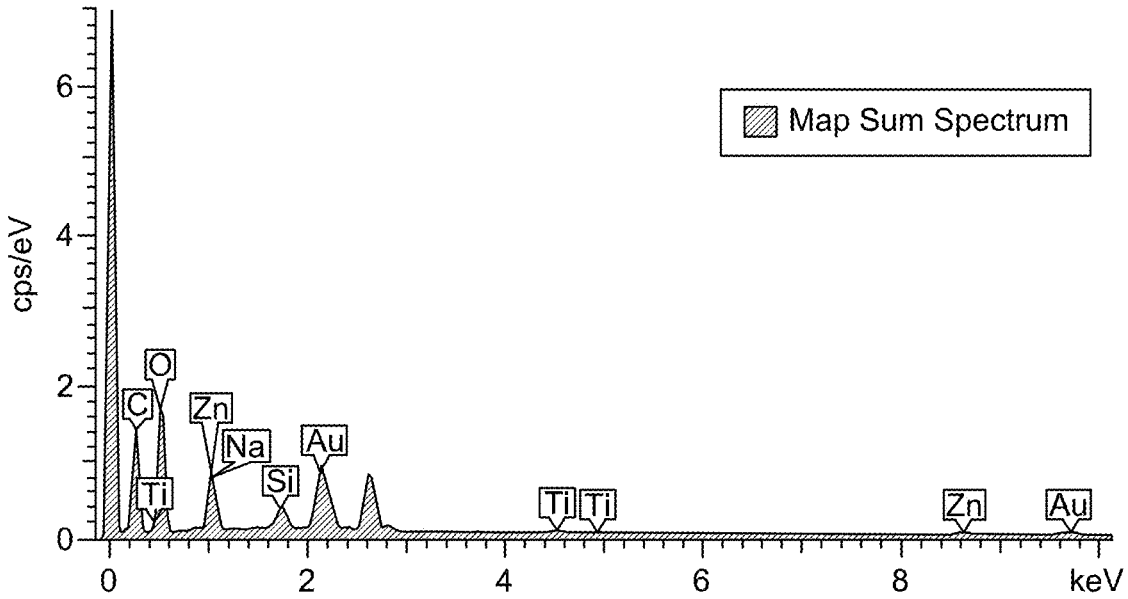
Figure 8A:
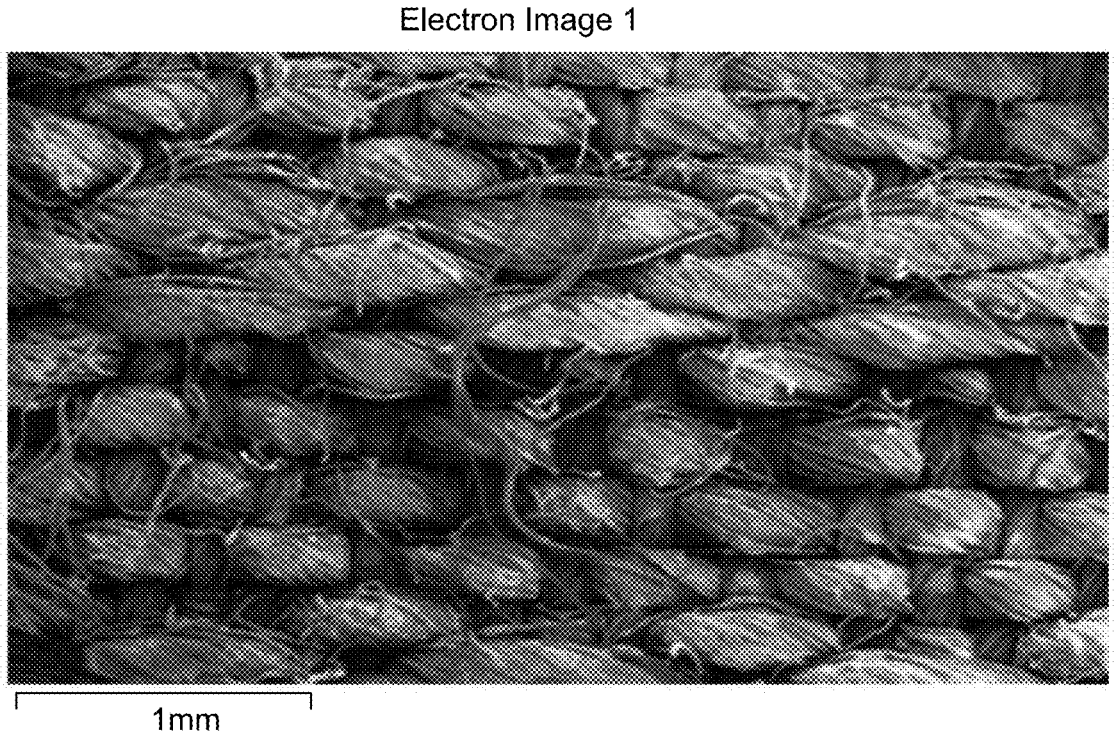
FIGS. 8A-8B illustrate the SEM and the EDX images of the antimicrobial coated textile including zirconium (Zr) nanoparticles, according to certain embodiments.
Figure 8B:
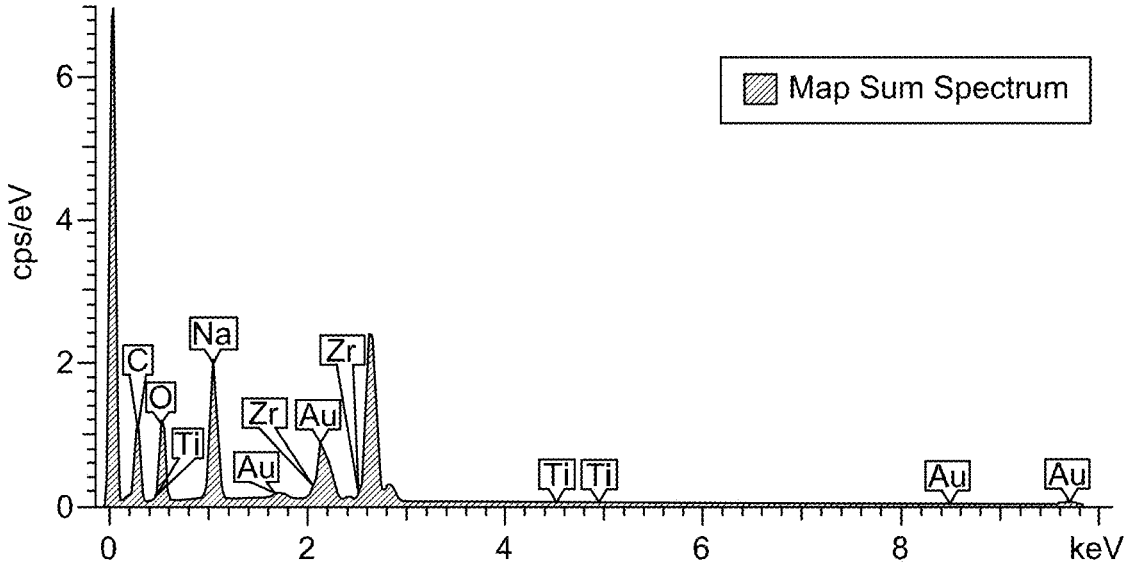

FIGS. 7A-7B and 8A-8B confirm layering of Zn and Zr nanoparticles (FIGS. 7A and 8A, respectively). Thin thread like structures and thick rope like structures refer to Zn and a fabric (FIG. 7A) and to Zr and a fabric (FIG. 8A). Presence of peaks (FIG. 7B) between 0.2 to 8.5 kilo electron volt (KeV) may be attributed to Ti, Zn, Si, O, confirming the formation of the coating over the fabric. Further, presence of peaks (FIG. 8B) between 0.1 to 4.5 KeV may be attributed to Ti, Zr, Si, O, confirming the formation of the coating over the fabric.

Fourier Transform Infrared Spectroscopy (FT-IR) spectra were acquired by employing a Nicolet 6700 FT-IR (Thermo Electron Corporation). The FT-IR spectra were achieved in a range of 4000-400 centimeter$^{-1}$ ($cm^{-1}$) with a 4 $cm^{-1}$ by assemblage of 32 scans. A characteristic peak for each coating was identified to prove the presence of the functional groups in the coating (not shown).

Figure 9B:
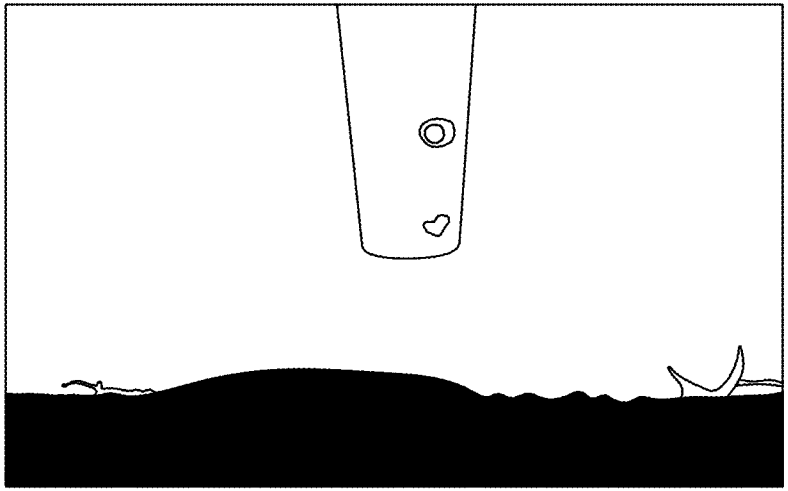
FIGS. 9A-9B illustrate images showing contact angles of textiles before and after exposure to a coating, respectively, according to certain embodiments.
Figure 9A:
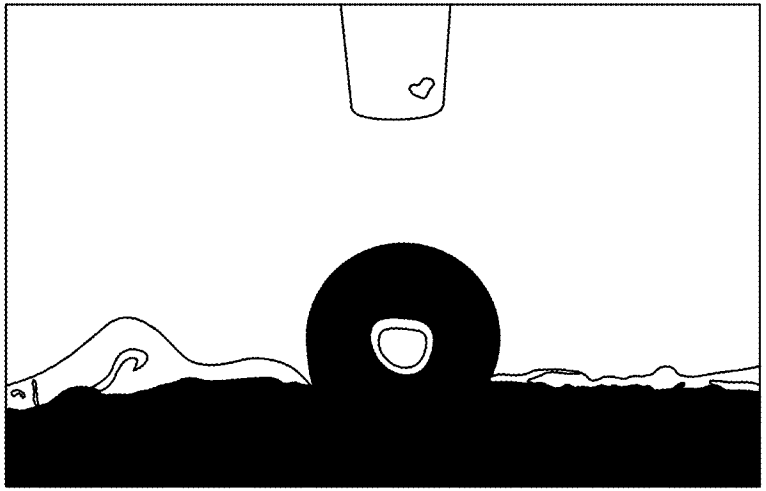
Figure 10B:
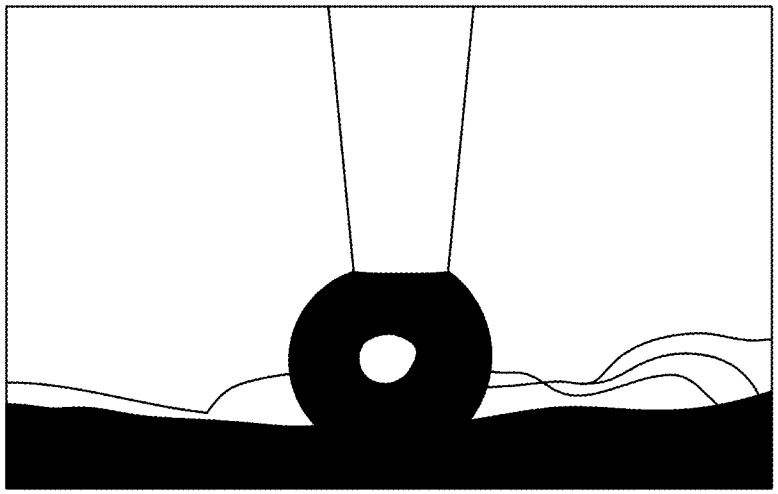
FIGS. 10A-10B illustrate images showing the contact angles of a 3M-polypropylene and Polytetrafluoroethylene (PTFE) High-Efficiency Particulate Arrestance (HEPA) textile fiber before and after exposure to the coating, according to certain embodiments.
Figure 10A:
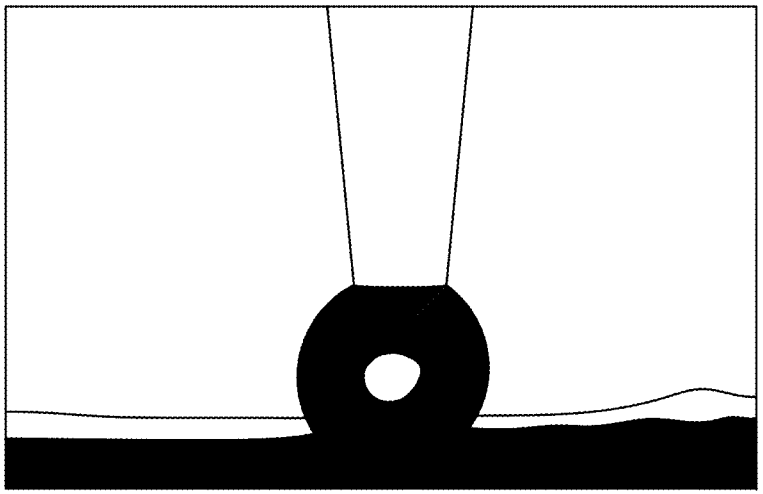
Figure 11B:
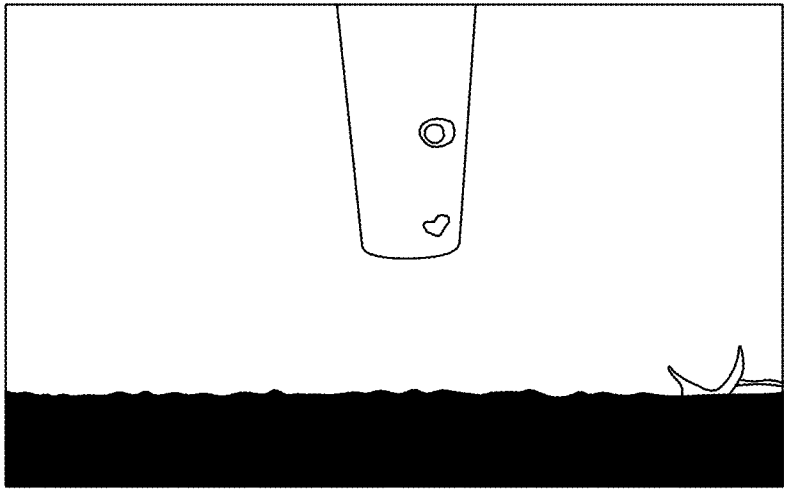
FIGS. 11A-11B illustrate images showing the contact angles of the textile including polypropylene and polystyrene, before and after exposure to the coating, according to certain embodiments.
Figure 11A:
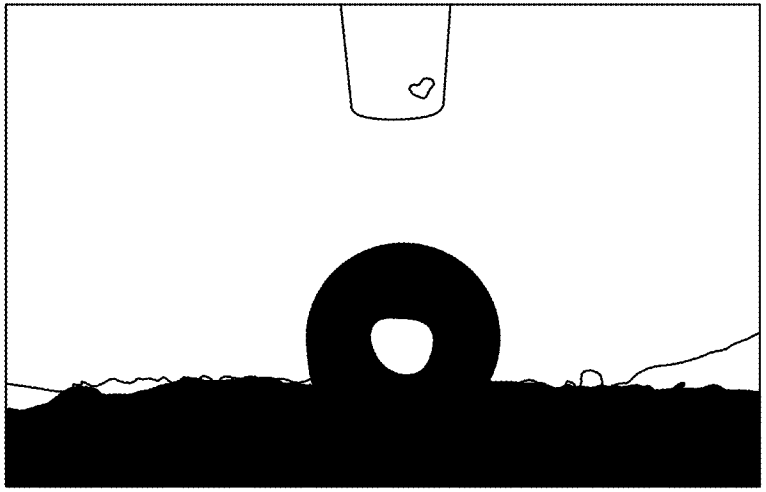

Referring to FIGS. 9A-9B, contact angles of fabrics before and after exposure to the coating is shown. Surfaces of untreated fabrics are hydrophobic in nature. Hence, the untreated fabrics include large contact angles. Coating with metal oxides having hydrophilic properties was found to reduce the contact angles. FIGS. 10A-10B show a slight decrease in contact angle of 3M-Polypropylene+PTFE (High-Efficiency Particulate Arrestance (HEPA)) fabrics before and after exposure to the coating. However, a large difference of 103.72° is observed in the contact angles of green-fabrics (Polypropylene (PP)+(propylene-silk) PS+PP) (FIGS. 11A-11B) before and after exposure to the coating.

TABLE 1

Data showing modified and unmodified contact angles.

| Fabrics | Modified-Contact Angle (Degree) | Unmodified-Contact Angle (Degree) |
|---|---|---|
| 3M-Polypropylene + PTFE (HEPA) | 127.49 | 127.59 |
| Wool | 79.25 | 119.20 |
| Polypropylene PP + PS + PP non-woven | 27.55 | 131.27 |
| Polyester + cotton (30:70) | 11.90 | 97.88 |
| Polyester | 33.30 | 98.99 |
| PP + PS + PP non-woven | 33.22 | 111.26 |
| Cotton | 35.24 | 61.78 |

From FIGS. 9A to 11B and Table 1, it may be observed that most of the untreated fabrics have the contact angles greater than 110 theta (θ). A reduction in the contact angles of the textile substrate with the coating deposition mixture was observed. The present observation confirms improved hydrophilic properties which further affect a wettability of the treated fabric.

Similarly, metal oxides with $TiO_2$ coated textiles' bond gaps were measured using Ultra-Violet (UV-Vis) spectroscopy. Bond angles of metal oxides deceased considerably (not shown) after doping with $TiO_2$.

Antibacterial Quality Assessment

Figure 12G:
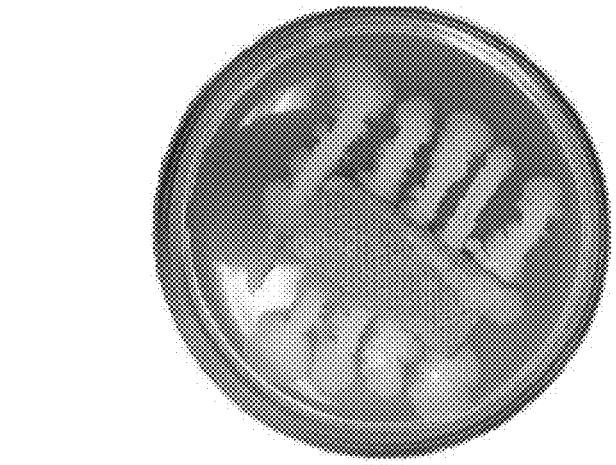
FIGS. 12A-12G illustrate images showing antibacterial activities of untreated and treated textile, according to certain embodiments.
Figure 12C:
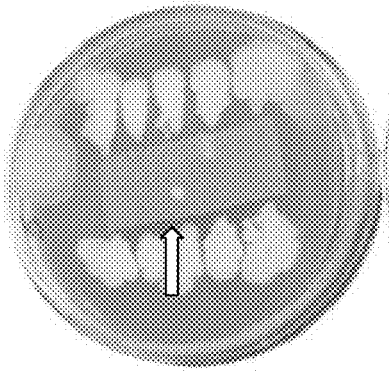
Figure 12F:
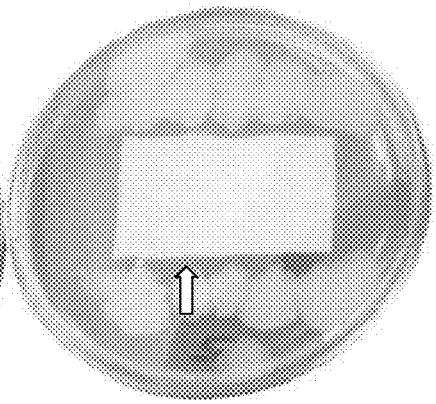
Figure 12B:
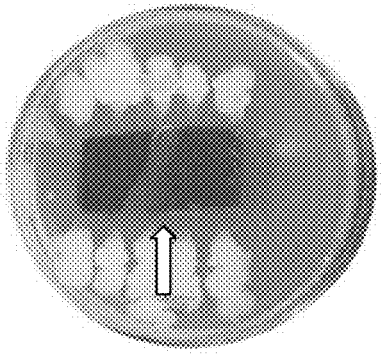
Figure 12E:
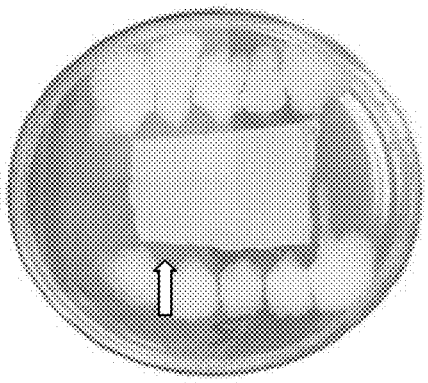
Figure 12A:
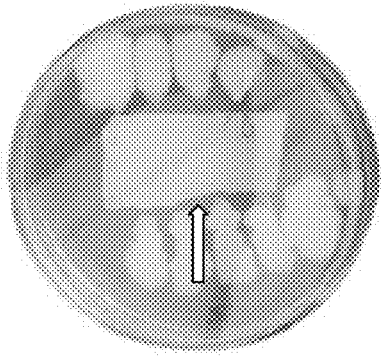
Figure 12D:
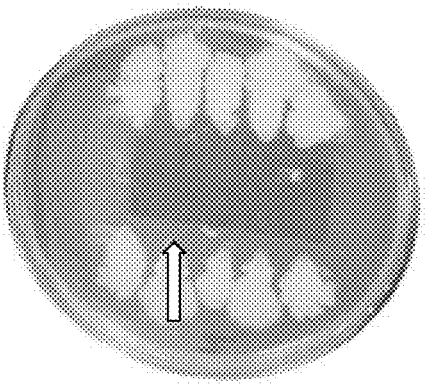

Referring to FIGS. 12A-12G, antibacterial activities of untreated and treated samples are illustrated. Hereinafter, the untreated and treated samples, otherwise referred to as the 'untreated or treated textiles/untreated and treated fabrics' or 'uncoated samples'. Antibacterial activities of untreated and treated samples were tested qualitatively by a parallel streak method (American Association of Textile Chemists and Colorists (AATCC-147) using *Bacillus substilis* (Gram-positive) and *Escherichia coli* (gram-negative) bacteria. In the parallel streak method, a bacterial suspension in the form of streaks was placed on nutrient agar plates with the help of a sterilized wire-loop. Two streaks of 1 cm apart from each other were made on an upper side of the nutrient agar plates. Then, fabric swatches (2 inch (in)×1 inch of the treated fabrics (FIGS. 12A-12F) representing cotton, woolen, polyester+cotton, PP+PS+PP non-woven, polyester, PP+PS+PP non-woven fabrics, respectively. and untreated fabric (FIG. 12G) were pressed on the nutrient agar plates and kept inside an incubator at 37±0.5° C. The incubation was carried out in a closed chamber incubator with a thermostat to maintain the set temperature. After 24 hours of incubation, the fabric swatches were examined for any potential bacterial growth underneath and around the specimen. FIGS. 12A-12F confirm complete absence of bacterial growth over and beneath surfaces of the treated fabrics. However, bacterial growth was not resisted with the use of the untreated fabric (FIG. 12G).

Photocatalytic Antibacterial Activity for Quantitative Method

Figure 13B:
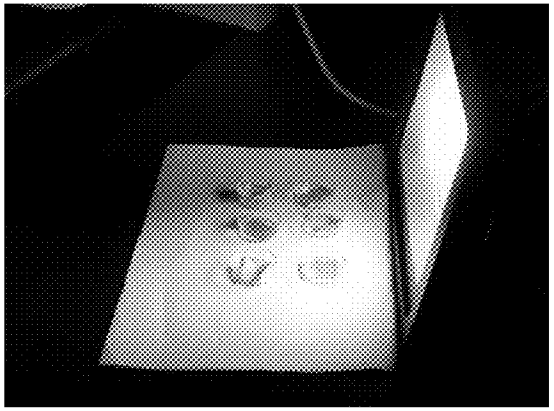
FIGS. 13A-13B illustrate experimental images showing photocatalytic antibacterial activity of untreated and treated textiles, according to certain embodiments.
Figure 13A:
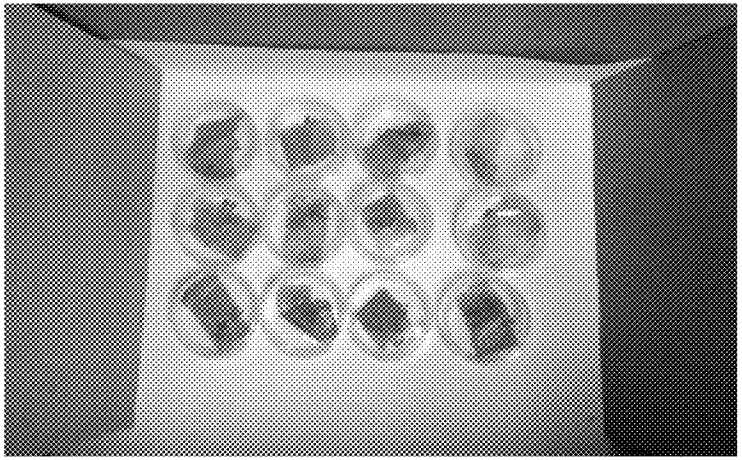

Photocatalytic measurements were conducted according to standard GB/T 30706-2014 procedure with a few modifications. One milliliter of a bacteria suspension (107 colony-forming units per milliliter (CFU $ml^{-1}$)) was dropped on fabric surfaces for both treated and untreated fabrics (FIG. 13A) and then irradiated by simulated light (FIG. 13B) for 1 hour at a density of 9000 milligram per milliliter (mg/ml). After a photocatalytic disinfection reaction, the fabrics were thoroughly washed with 10 ml of 0.9% (weight per volume (w/v)) saline solution and the resultant eluent bacterial suspensions were diluted serially, for example, $10^{-3}$, $10^{-4}$, $10^{-5}$ and $10^{-6}$ times, using sterilized water. 100 microliters (μl) of the diluted bacterial suspension was spread on the nutrient agar plates and incubated again at 37±0.5° C. Then a viable cell count was performed to obtain the results for disinfection. A plurality of experiments was also conducted in the dark in the same conditions described above. A light control group was performed in the absence of a photocatalyst.

A percent reduction in number of bacterial colonies in the treated fabric as compared to the untreated fabric gives the antibacterial activity of the treated fabric. The antibacterial activity is provided as equation (1):

$$\frac{A-B}{A}\times 100 \tag{1}$$

Where A is bacterial colonies (CFU/ml) of the untreated fabric, and B is bacterial colonies of the treated fabrics.

Figure 14C:
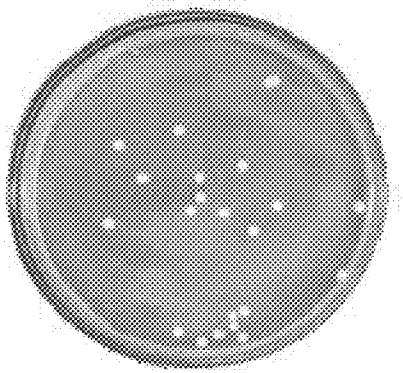
FIGS. 14A-14C illustrate resulting images showing photocatalytic antibacterial activity of the untreated and treated textiles, according to certain embodiments.
Figure 14B:
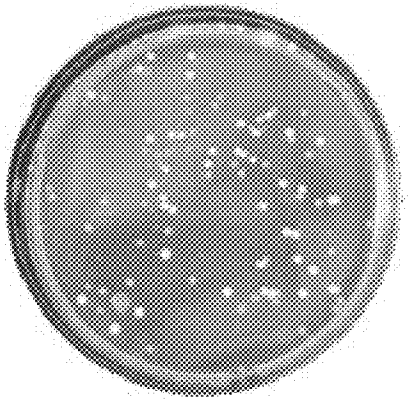
Figure 14A:
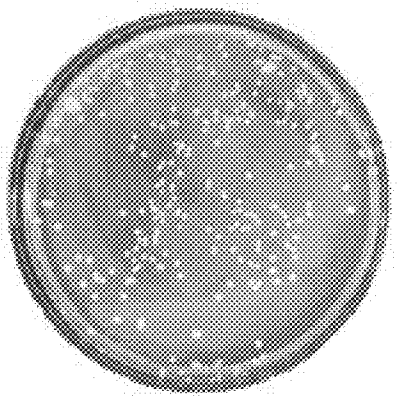

Referring to FIGS. 14A-14C, images of the nutrient agar plates are illustrated. Three nutrient agar plates were considered. A nutrient agar plate 1, includes bacterial colonies for untreated fabric and zero exposure to lightening, a nutrient agar plate 2, includes bacterial colonies with the treated fabric, and no light exposure, and a nutrient agar plate 3 includes bacterial colonies with the treated fabric, in presence of light. As may be observed from the FIGS. 14A-14C, a minimal viable bacterial count was found to be best with the nutrient agar plate 3. The viable bacterial count for each of such plates is: nutrient agar plate 1>nutrient agar plate 2>nutrient agar plate 3. A maximum bacterial count is evident with the untreated fabric and zero lightening. Hence, the present experiment demonstrates improved antibacterial activities in the presence of light.

Washing Fastness of an Antimicrobial Fabric Test

Figure 15A:
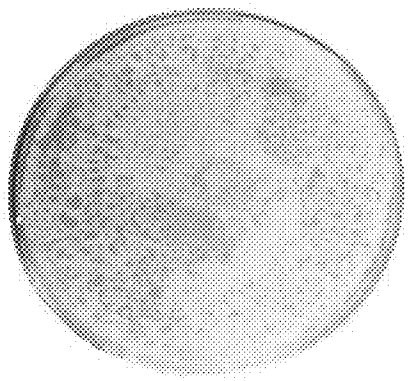
FIGS. 15A-15F illustrate images showing washing fastness of an antimicrobial test, according to certain embodiments.
Figure 15B:
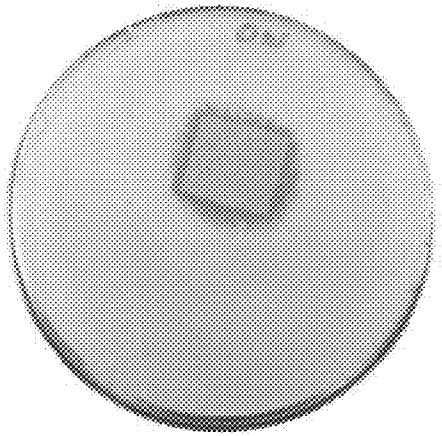
Figure 15C:
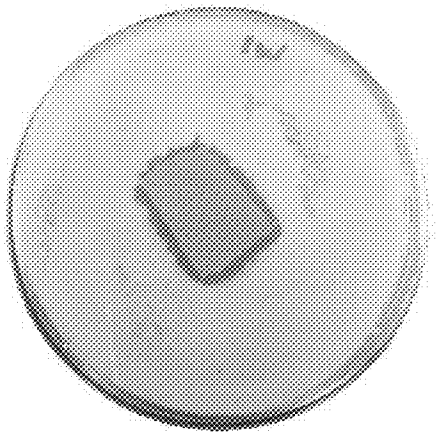
Figure 15D:
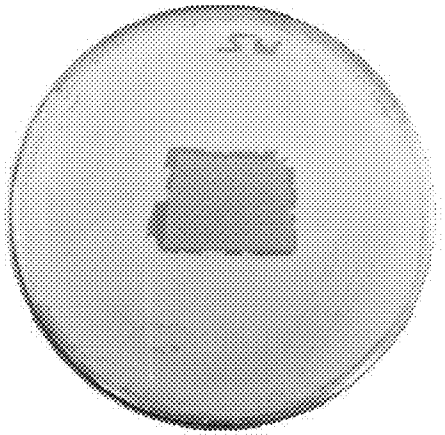
Figure 15E:
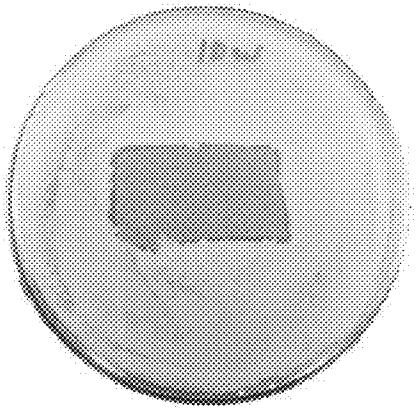
Figure 15F:
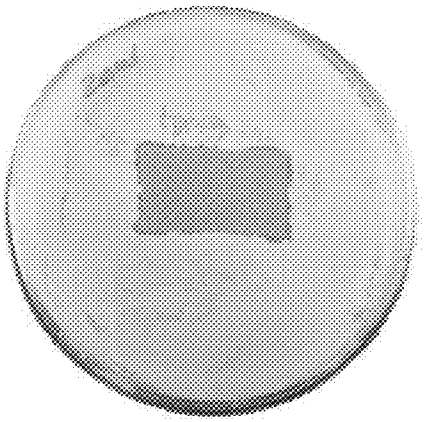

Treated and untreated fabrics were washed according to a RAL-GZ 992 procedure with few modifications. Washing fastness evaluated after repetitive washing using an American Association of Textile Chemists and Colorists (AATCC) Atlas Launder-O-Meter standard instrument. One wash in such instrument (International Organization for Standardization (ISO) 105-C01:1989(E) standard method) corresponds to five home washings. The washing duration was 30 minutes, and a solution of Sodium dodecyl sulfate (SDS) standard detergent (5 g/L) was used. Subsequently, the treated cotton fabrics were rinsed in distilled water, placed under a cold water tap for 10 minutes and dried. No antibacterial activity can be observed in FIG. 15A as bacteria is growing over surfaces of the untreated fabric. However, no bacterial growth can be observed over surfaces of the treated fabrics (FIGS. 15B-15F). The treated fabrics show the antibacterial activity even after 20 washes (FIG. 15F).

Bacterial Filtration Efficiency (BFE) Test

Figure 16:
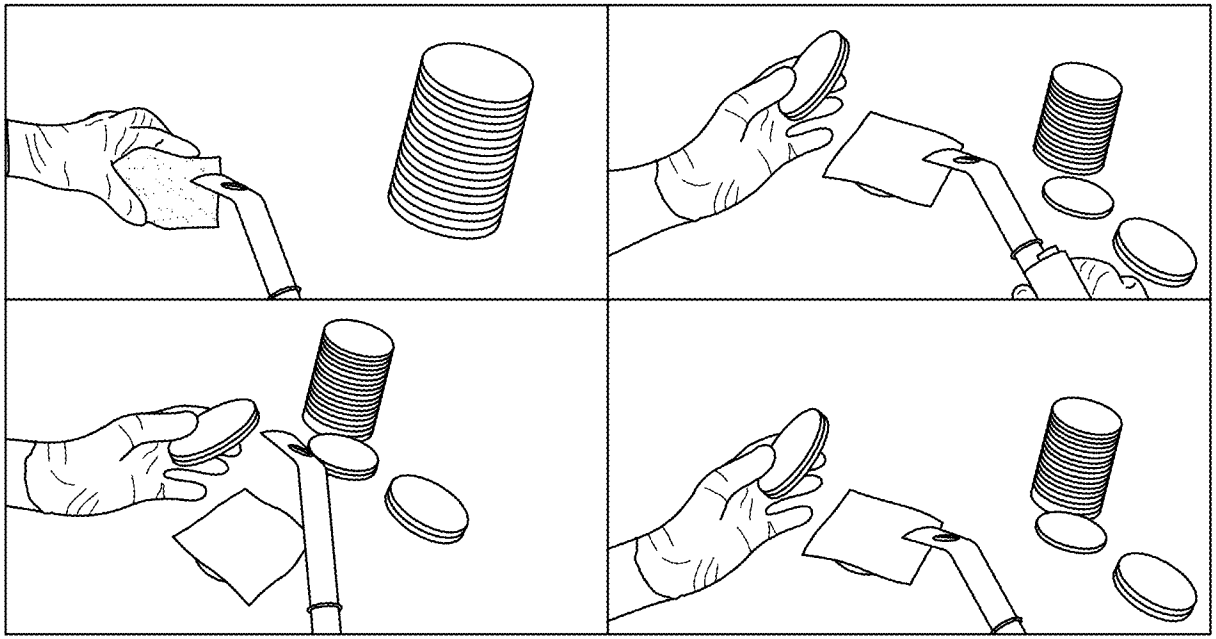
FIG. 16 illustrates an image showing evaluation of Bacterial Filtration Efficiency (BFE) of coated and uncoated textiles, according to certain embodiments.

A BFE test was performed on filtration materials and devices that are designed to provide protection against biological aerosols. The BFE test determines a filtration efficiency by comparing bacterial control counts to test fabric effluent counts. The BFE test was conducted according to the American Society for Testing and Materials (ASTM) F2100 standard with few modifications by using *Bacillus substilis*. A liquid suspension of bacteria was aerosolized and delivered to filtration fabrics (10 cm×10 cm) (FIG. 16) at a constant flow rate of 0.2 ml $min^{-1}$ for 1 minute under a nutrient agar media, the nutrient agar plates were incubated at 37° C. for 20 hours. Then, the viable cell count was performed to obtain the results colony forming units (CFU). Filtration efficiency measurements can be determined by up to >99.99%.

Photocatalytic Air Disinfection Test

Figure 17:
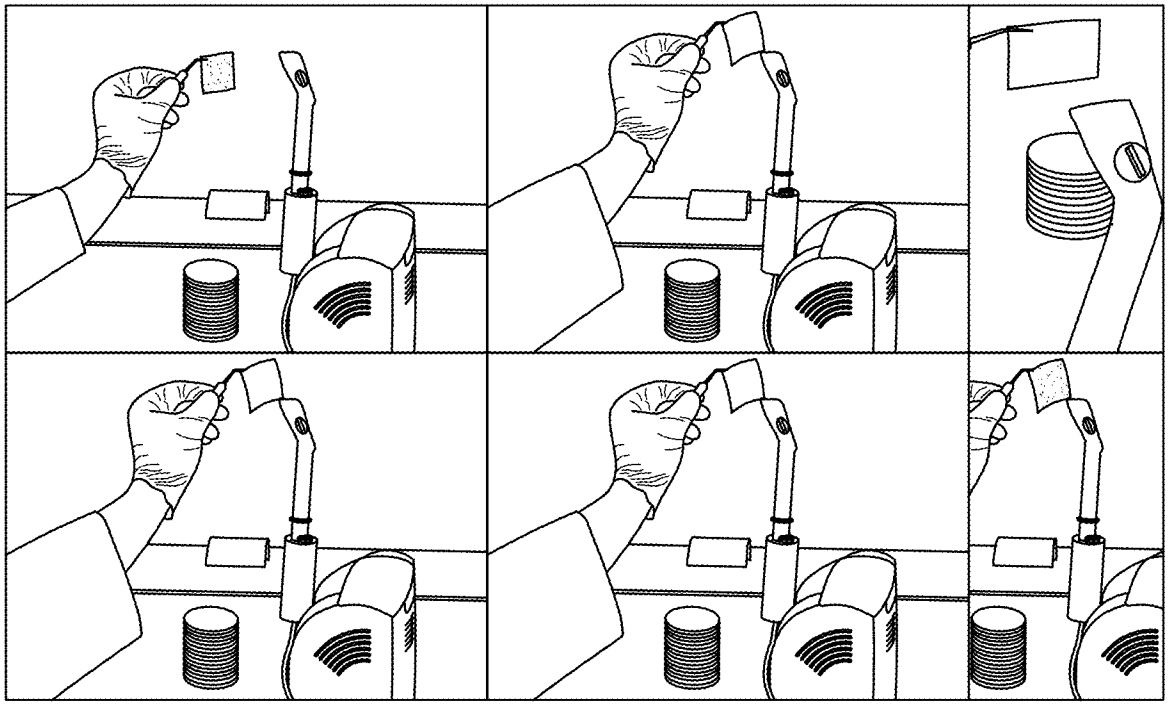
FIG. 17 illustrates an image showing photocatalytic air disinfection activity of coated and uncoated textiles, according to certain embodiments.

*Bacillus substilis* containing aerosols with particle diameter from 1 to 5 μm, were prepared as model aerosols by nebulizing $10^2$ CFU $ml^{-1}$ of *B. substilis* suspension into a reaction section at the flow rate of 0.2 ml $min^{-1}$ for 1 minute (FIG. 17). The treated fabrics were exposed to the aerosols under simulate light illumination for 1 hour. Samples were placed on using nutrient agar and incubated at 37° C. for 20 h. After incubation, the bacterial colonies ware counted.

Figure 18:
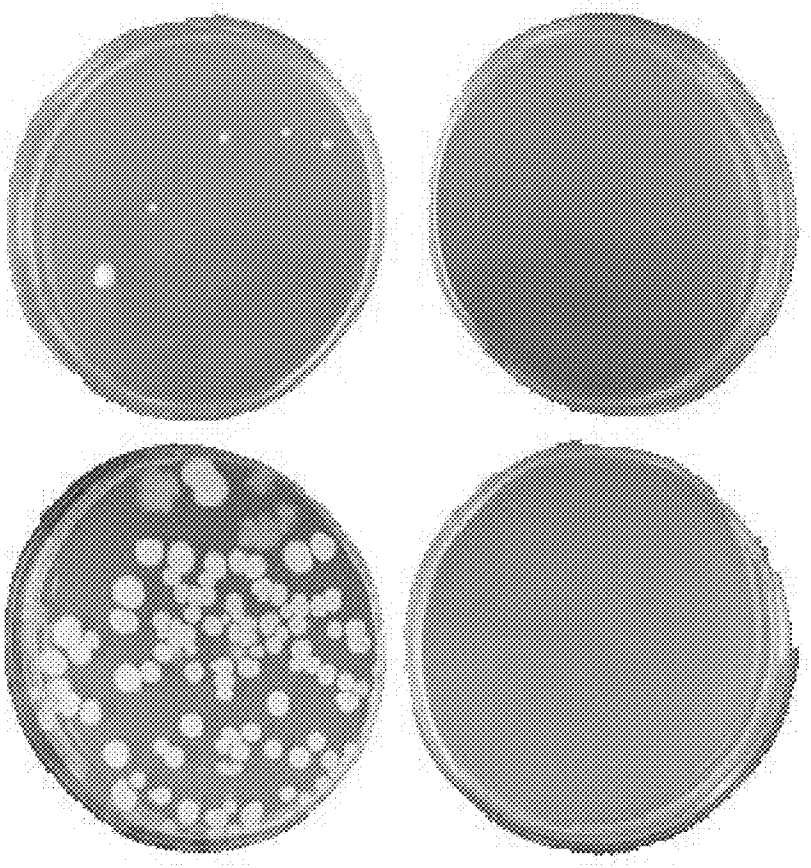
FIG. 18 illustrates an image showing BEFs of the coated and uncoated textiles, according to certain embodiments.

The results of this study are illustrated in the FIG. 18. From the FIG. 18, it can be observed that the coated fabrics do not have any bacterial CFU compared to the uncoated samples. BFE results range from 1-99.9% as the present values are low (<1) and high (>99.9) detection limits. The coated fabrics were found to have >99.99% efficiency. The uncoated samples in both media had <1%.

Figure 19B:
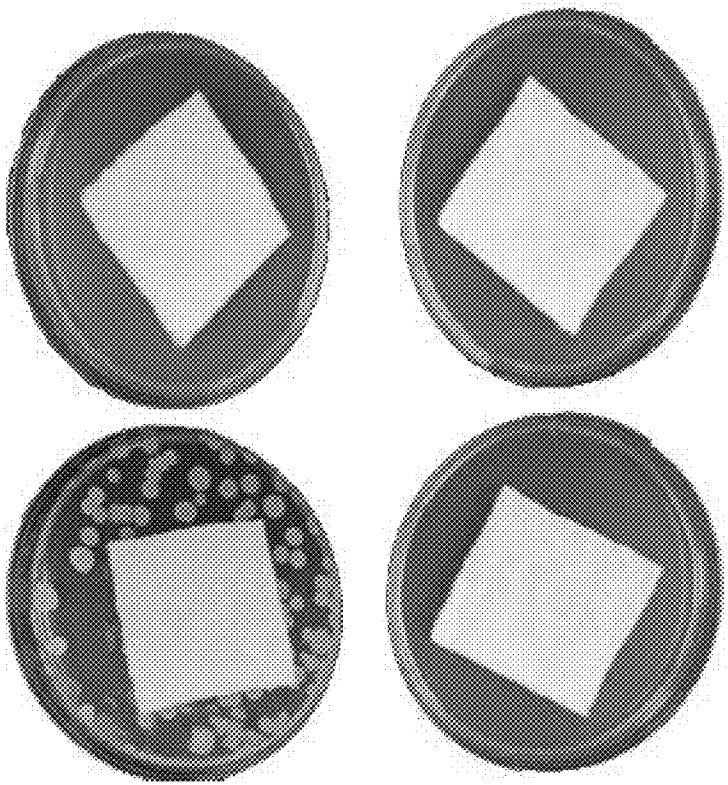
FIGS. 19A-19B illustrate images showing a photocatalytic air disinfection activity of the coated and uncoated textiles, according to certain embodiments.
Figure 19A:
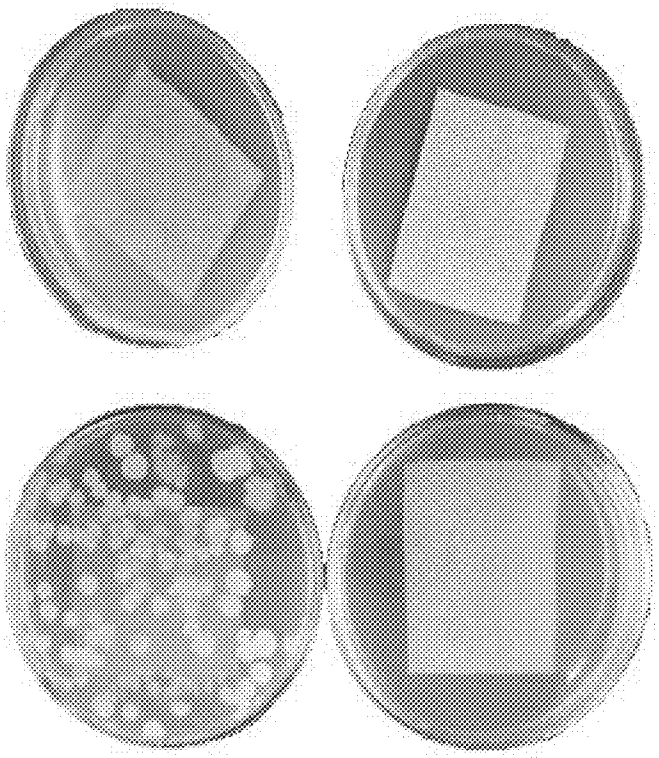

FIGS. 19A-19B show the photocatalytic air disinfection activity of the coated and uncoated fabrics (polyester+cotton and PP+PS+PP non-woven fabrics, respectively) was evaluated under the same conditions described above. The results suggest that the coated samples can completely eliminate bacteria in an aerosol by nebulizing $10^2$ CFU $ml^{-1}$ of *B. substiles* suspension sprayed into the reaction section at the flow rate of 0.2 ml $min^{-1}$ for 1 minute in a single pass. The uncoated samples do not have aforesaid efficacy.

Obviously, numerous modifications and variations of the present disclosure are possible in light of the above teachings. It is therefore to be understood that within the scope of the appended claims, the invention may be practiced otherwise than as specifically described herein.

The invention claimed is:

1. An antimicrobial coated textile, comprising:

a textile substrate comprising a plurality of textile fibers; and a coating comprising:

77.5 to 97.45 wt. % silica, 0.05 to 2.5 wt. % titanium dioxide, and 2.5 to 20 wt. % an oxide of a second metal, each based on a total weight of the coating, wherein the second metal is selected from a group consisting of Zn, Se, Fe, Cu, and Zr, and the coating is disposed on a surface of the textile fibers, and wherein the coating comprises agglomerates having a mean agglomerate size of 0.5 to 50 μm.

2. The antimicrobial coated textile of claim 1, wherein the titanium dioxide is present as particles having a mean particle size of 10 to 300 nanometers (nm).

3. The antimicrobial coated textile of claim 1, wherein the oxide of a second metal is present as particles having a mean particle size of 10 to 300 nm.

4. The antimicrobial coated textile of claim 1, wherein the coating has a thickness of 5 to 500 micrometer (μm).

5. An antimicrobial coated textile, comprising:

a textile substrate comprising a plurality of textile fibers; and a coating comprising:

77.5 to 97.45 wt. % silica, 0.05 to 2.5 wt. % titanium dioxide, and 2.5 to 20 wt. % an oxide of a second metal, each based on a total weight of the coating, wherein the second metal is selected from a group consisting of Zn, Se, Fe, Cu, and Zr, and the coating is disposed on a surface of the textile fibers, wherein the coating comprises agglomerates having a mean agglomerate size of 0.5 to 50 μm, wherein the agglomerates collectively comprise 25 to 75 wt. % of the silica present in the coating and 25 to 75 wt. % of the oxide of the second metal present in the coating.

6. The antimicrobial coated textile of claim 1, wherein the coating has an optical bandgap of 2 to 3.5 electron volts (eV).

7. The antimicrobial coated textile of claim 1, wherein the textile fibers are at least one selected from a group consisting of silk, hair, linen, hemp, jute, ramie, manila, sisal, kapok, coir, cotton, a nylon, a rayon, an acrylic, a terylene, an elastane, a polyolefin, and a polyester.

8. The antimicrobial coated textile of claim 7, wherein the textile fibers are at least one selected from a group consisting of cotton and a polyester.

9. The antimicrobial coated textile of claim 1, having a water contact angle of 7.5 to 90°.

10. The antimicrobial coated textile of claim 1, having a water contact angle which is 5 to 75% of a water contact angle of an uncoated textile formed of the same textile fibers.

11. The antimicrobial coated textile of claim 1, wherein the coating comprises:

86.5 to 92.25 wt. % silica, 0.25 to 1.0 wt. % titanium dioxide, and 7.5 to 12.5 wt. % of the oxide of a second metal, each based on a total weight of the coating.

12. The antimicrobial coated textile of claim 1, wherein the coating is substantially free of binders and/or adhesives.

13. A bandage, a cast, a gown, a lab coat, a mask, a shoe covering, a face covering, a curtain, a bedcovering, a carpeting, or a head covering comprising the antimicrobial coated textile of claim 1.

* * * * *